US009468050B1

(12) United States Patent
Rotzoll et al.

(10) Patent No.: US 9,468,050 B1
(45) Date of Patent: Oct. 11, 2016

(54) SELF-COMPENSATING CIRCUIT FOR FAULTY DISPLAY PIXELS

(71) Applicant: X-Celeprint Limited, Cork (IE)

(72) Inventors: Robert R. Rotzoll, Colorado Springs, CO (US); Ronald S. Cok, Rochester, NY (US)

(73) Assignee: X-Celeprint Limited, Cork (IE)

( * ) Notice: Subject to any disclaimer, the term of this patent is extended or adjusted under 35 U.S.C. 154(b) by 0 days.

(21) Appl. No.: 14/795,830

(22) Filed: Jul. 9, 2015

Related U.S. Application Data

(60) Provisional application No. 62/170,583, filed on Jun. 3, 2015.

(51) Int. Cl.
*G09G 3/30* (2006.01)
*H05B 33/08* (2006.01)
*G09G 3/32* (2016.01)

(52) U.S. Cl.
CPC ..... *H05B 33/0815* (2013.01); *G09G 3/3233* (2013.01); *G09G 3/3275* (2013.01)

(58) Field of Classification Search
CPC ..... G09G 3/3233; G09G 3/3275
USPC ..... 345/77, 84, 89, 95, 210, 690
See application file for complete search history.

(56) References Cited

U.S. PATENT DOCUMENTS 5,550,066 A 8/1996 Tang et al.
5,621,555 A 4/1997 Park
5,815,303 A 9/1998 Berlin
6,278,242 B1 8/2001 Cok et al.
6,577,367 B2 6/2003 Kim
6,717,560 B2 4/2004 Cok et al.
6,756,576 B1 6/2004 McElroy et al.
6,933,532 B2 8/2005 Arnold et al.
7,129,457 B2 10/2006 McElroy et al.
7,195,733 B2 3/2007 Rogers et al.
7,288,753 B2 10/2007 Cok
7,521,292 B2 4/2009 Rogers et al.
7,557,367 B2 7/2009 Rogers et al.
7,586,497 B2 9/2009 Boroson et al.
7,622,367 B1 11/2009 Nuzzo et al.
7,662,545 B2 2/2010 Nuzzo et al.
7,704,684 B2 4/2010 Rogers et al.
7,799,699 B2 9/2010 Nuzzo et al.
7,816,856 B2 10/2010 Cok et al.
7,893,612 B2 2/2011 Cok (Continued)

FOREIGN PATENT DOCUMENTS

WO WO-2008/103931 A2 8/2008

OTHER PUBLICATIONS

Roscher, H., VCSEL Arrays with Redundant Pixel Designs for 10Gbits/s 2-D Space-Parallel MMF Transmission, Annual Report, optoelectronics Department, (2005).

(Continued)

*Primary Examiner* — Tung X Le
(74) *Attorney, Agent, or Firm* — Choate, Hall and Stewart LLP; William R. Haulbrook

(57) ABSTRACT

A self-compensating circuit for controlling pixels in a display includes a plurality of light-emitter circuits. Each light-emitter circuit includes a light emitter, a control transistor, a drive transistor, and a compensation circuit. The compensation circuit is connected to the light emitter of one or more different light-emitter circuits.

20 Claims, 19 Drawing Sheets

(56) References Cited

U.S. PATENT DOCUMENTS

| | | | |
|---|---|---|---|
| 7,927,976 | B2 | 4/2011 | Menard |
| 7,932,123 | B2 | 4/2011 | Rogers et al. |
| 7,943,491 | B2 | 5/2011 | Nuzzo et al. |
| 7,972,875 | B2 | 7/2011 | Rogers et al. |
| 7,982,296 | B2 | 7/2011 | Nuzzo et al. |
| 7,999,454 | B2 | 8/2011 | Winters et al. |
| 8,029,139 | B2 | 10/2011 | Ellinger et al. |
| 8,039,847 | B2 | 10/2011 | Nuzzo et al. |
| 8,198,621 | B2 | 6/2012 | Rogers et al. |
| 8,207,547 | B2 | 6/2012 | Lin |
| 8,261,660 | B2 | 9/2012 | Menard |
| 8,334,545 | B2 | 12/2012 | Levermore et al. |
| 8,394,706 | B2 | 3/2013 | Nuzzo et al. |
| 8,440,546 | B2 | 5/2013 | Nuzzo et al. |
| 8,470,701 | B2 | 6/2013 | Rogers et al. |
| 8,502,192 | B2 | 8/2013 | Kwak et al. |
| 8,506,867 | B2 | 8/2013 | Menard |
| 8,664,699 | B2 | 3/2014 | Nuzzo et al. |
| 8,686,447 | B2 | 4/2014 | Tomoda et al. |
| 8,722,458 | B2 | 5/2014 | Rogers et al. |
| 8,754,396 | B2 | 6/2014 | Rogers et al. |
| 8,766,970 | B2 | 7/2014 | Chien et al. |
| 8,791,474 | B1 | 7/2014 | Bibl et al. |
| 8,794,501 | B2 | 8/2014 | Bibl et al. |
| 8,803,857 | B2 | 8/2014 | Cok |
| 8,817,369 | B2 | 8/2014 | Daiku |
| 8,854,294 | B2 | 10/2014 | Sakariya |
| 8,877,648 | B2 | 11/2014 | Bower et al. |
| 8,889,485 | B2 | 11/2014 | Bower |
| 8,895,406 | B2 | 11/2014 | Rogers et al. |
| 8,987,765 | B2 | 3/2015 | Bibl et al. |
| 2004/0252089 | A1* | 12/2004 | Ono ..... G09G 3/3233 345/82 |
| 2010/0248484 | A1 | 9/2010 | Bower et al. |
| 2011/0073860 | A1* | 3/2011 | Kanno ..... H01L 29/41733 257/57 |
| 2012/0228669 | A1 | 9/2012 | Bower et al. |
| 2012/0314388 | A1 | 12/2012 | Bower et al. |
| 2013/0069275 | A1 | 3/2013 | Menard et al. |
| 2013/0088416 | A1 | 4/2013 | Smith et al. |
| 2013/0196474 | A1 | 8/2013 | Meitl et al. |
| 2013/0207964 | A1 | 8/2013 | Fleck et al. |
| 2013/0221355 | A1 | 8/2013 | Bower et al. |
| 2013/0273695 | A1 | 10/2013 | Menard et al. |
| 2014/0104243 | A1 | 4/2014 | Sakariya et al. |
| 2014/0264763 | A1 | 9/2014 | Meitl et al. |
| 2014/0267683 | A1 | 9/2014 | Bibl et al. |
| 2014/0367633 | A1 | 12/2014 | Bibl et al. |
| 2015/0135525 | A1 | 5/2015 | Bower |
| 2015/0137153 | A1 | 5/2015 | Bibl et al. |

OTHER PUBLICATIONS

Yaniv et al., A 640×480 Pixel Computer Display Using Pin Diodes with Device Redundancy, 1988 International Display Research Conference, IEEE, CH-2678-1/88:152-154 (1988).

* cited by examiner

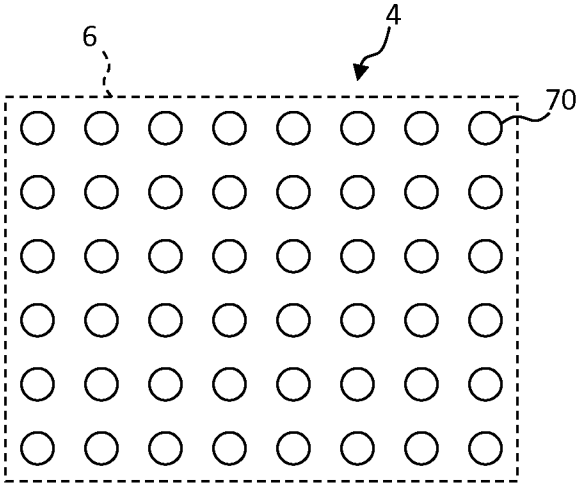
FIG. 6
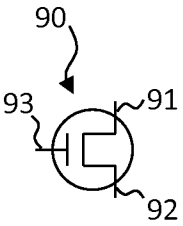
FIG. 5 – Prior Art

SELF-COMPENSATING CIRCUIT FOR FAULTY DISPLAY PIXELS

PRIORITY APPLICATION

This application claims priority to and the benefit of U.S. Provisional Patent Application No. 62/170,583, filed Jun. 3, 2015, entitled "Self-Compensating Circuit for Faulty Display Pixels," the contents of which is incorporated by reference herein in its entirety.

CROSS REFERENCE TO RELATED APPLICATION

Reference is made to U.S. Provisional Patent Application No. 62/170,589, filed Jun. 3, 2015, entitled "Self-Compensating Circuit for Faulty Display Pixels," U.S. Provisional Patent Application Ser. No. 62/055,472 filed Sep. 25, 2014, entitled "Compound Micro-Assembly Strategies and Devices," and U.S. patent application Ser. No. 14/743,981 filed Jun. 18, 2015 and entitled "Micro-Assembled Micro LED Displays and Lighting Elements," the contents of each of which is incorporated herein by reference in its entirety.

FIELD OF THE INVENTION

The present invention relates to a control circuit for providing fault tolerance to pixels in a display.

BACKGROUND OF THE INVENTION

Flat-panel displays are widely used in computing devices, in portable devices, and for entertainment devices such as televisions. Such displays typically employ a plurality of pixels distributed in an array over a display substrate to display images, graphics, or text. For example, liquid-crystal displays (LCDs) employ liquid crystals to block or transmit light from a backlight behind the liquid crystals. Organic light-emitting diode (OLED) displays rely on passing current through a layer of organic material that glows in response to the electrical current. Each pixel usually includes three or more sub-pixels emitting light of different colors, for example red, green, and blue, Displays are typically controlled with either a passive-matrix (PM) control employing electronic circuitry external to the display substrate or an active-matrix (AM) control employing electronic circuitry formed directly on the display substrate and associated with each light-emitting element. Both OLED displays and LCDs using passive-matrix control and active-matrix control are available. An example of such an AM OLED display device is disclosed in U.S. Pat. No. 5,550,066.

Typically, each display sub-pixel is controlled by one control element, and each control element includes at least one transistor. For example, in a simple active-matrix OLED display, each control element includes two transistors (a select transistor and a drive transistor) and one capacitor for storing a charge specifying the desired luminance of the sub-pixel. Each OLED element employs an independent control electrode connected to the power transistor and a common electrode. In contrast, an LCD typically uses a single-transistor circuit. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

Active-matrix circuitry is commonly achieved by forming thin-film transistors (TFTs) in a semiconductor layer formed on a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors, Additional layers, for example insulating dielectric layers and conductive metal layers are provided, often by evaporation or sputtering, and photolithographically patterned to form electrical interconnections, structures, or wires.

In any display device it is important that light is uniformly displayed from the pixels arranged over the extent of the display when correspondingly controlled by a display controller to avoid visible non-uniformities or irregularities in the display. As display size and resolution increase, it becomes more difficult to manufacture displays without any pixel defects and therefore manufacturing yields decrease and costs increase. To increase yields, fault-tolerant designs are sometimes incorporated into the displays, particularly in the circuitry used to control the pixels in the display or by providing additional redundant pixels or sub-pixels.

Numerous schemes have been suggested to provide pixel fault tolerance in displays. For example, U.S. Pat. No. 5,621,555 describes an LCD with redundant pixel electrodes and thin-film transistors and U.S. Pat. No. 6,577,367 discloses a display with extra rows or columns of pixels that are used in place of defective or missing pixels in a row or column. U.S. Pat. No. 8,766,970 teaches a display pixel circuit with control signals to determine and select one of two emitters at each sub-pixel site on the display substrate.

Furthermore, in flat-panel displays using thin-film transistors formed in an amorphous or polysilicon layer on a substrate, the additional circuitry required to support complex control schemes can further reduce the aperture ratio or be difficult or impossible to implement for a particular display design.

There remains a need, therefore, for a design and manufacturing method that enables fault tolerance in a display without compromising the aperture ratio of the display or limiting display design options.

SUMMARY OF THE INVENTION

The present invention provides a self-compensating circuit for controlling pixels in a display. In an embodiment, the self-compensating circuit and pixels are formed on a substrate, for example in a thin film of semiconductor material. In another embodiment, the pixels include inorganic light emitters that are micro transfer printed onto a display substrate as well as controllers incorporating the self-compensating control circuit. Alternatively, the light emitters or controllers are micro-transfer printed onto a pixel substrate separate and independent from the display substrate. The pixel substrates are then located on the display substrate and electrically interconnected, for example using conventional photolithography. Because the inorganic light emitters are relatively small compared to other light-controlling elements such as liquid crystals or OLEDs, a more complex, self-compensating control circuit does not decrease the aperture ratio of the display.

According to embodiments of the present invention, a self-compensating circuit compensates for a missing or defective light emitter by increasing the current supplied to other light emitters, for example light emitters that are spatially adjacent on a substrate. The increased current supplied to the other spatially adjacent light emitters causes an increase in light output by the other emitters, so that the overall light output is the same as if all of the light emitters are functioning. When all of the light emitters are working properly, each circuit independently supplies current to the light emitters according to a control drive signal. When one or more of the light emitters are not present or fail, the self-compensating control circuit for each faulty light emitter supplies current to the other light emitters in the self-compensating circuit according to the control drive signal of the faulty light emitter. This provides fault tolerance for missing or defective pixels without requiring external detection or control of the defective pixels. If the pixels are arranged over the substrate with a sufficiently high resolution, the compensated light output is not readily noticed by an observer.

The disclosed technology, in certain embodiments, provides a self-compensating circuit for controlling pixels in a display having fault tolerance for missing or defective pixels without requiring external detection or control of the defective pixels. In an embodiment, the self-compensating circuit does not decrease the aperture ratio of the display.

In one aspect, the disclosed technology includes a self-compensating circuit for controlling pixels in a display, including: a plurality of light-emitter circuits, each light-emitter circuit comprising: a light emitter having a power connection to a power supply and an emitter connection; a control transistor having a gate and a drain connected to the emitter connection and a source connected to a compensation connection; a drive transistor having a gate connected to a drive signal, a drain connected to the compensation connection, and a source connected to a ground; and a compensation circuit comprising one or more compensation transistors, each compensation transistor having a gate connected to a bias connection, a source connected to the compensation connection, and a drain, wherein the drain of each compensation transistor in each light-emitter circuit is connected to an other emitter connection of one or more light-emitter circuits other than the light-emitting circuit of which the compensation transistor is a part, thereby emitting compensatory light from the one or more light-emitter circuits when the light emitter is faulty.

In certain embodiments, the light emitters are inorganic light-emitters.

In certain embodiments, the inorganic light emitters are inorganic light-emitting diodes.

In certain embodiments, the compensation transistors in a light-emitter circuit have a size equal to or smaller than the control transistor.

In certain embodiments, the size of the compensation transistors in a light-emitter circuit is inversely related to the number of compensation transistors in the light-emitter circuit.

In certain embodiments, the size of the compensation transistors in a light-emitter circuit is less than or equal to the size of the control transistor divided by the number of compensation transistors.

In certain embodiments, the number of compensation transistors in each light-emitter circuit is one fewer than the number of light emitters in the self-compensating circuit.

In certain embodiments, each compensation circuit of the plurality of light-emitter circuits has one compensation transistor and the drain of the one compensation transistor of each of the plurality of light-emitter circuits is electrically connected in common to a common compensation connection and wherein each compensation circuit comprises a transfer transistor having a gate and a drain connected to the emitter connection and a source connected to the common compensation connection.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In certain embodiments, the disclosed technology includes a self-compensating display, including an array of light emitters forming rows and columns on a display substrate, each light emitter controlled by the self-compensating circuit.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein the drain of each compensation transistor in a light-emitter circuit is connected to a different one of the other emitter connections in the light-emitter circuits of the other light emitters in the exclusive group.

In certain embodiments, the number of compensation transistors in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein the source of each compensation transistor in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitters having a left light emitters to the left of the central light emitters, a right light emitters to the right of the central light emitters, an upper light emitters above the central light emitters, and a lower light emitters below the central light emitters.

In certain embodiments, each group of adjacent pixels comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter.

In certain embodiments, the one or more compensation transistors includes at least a first compensation transistor and a second compensation transistor different from the first compensation transistor and wherein the first and second compensation transistors have different sizes.

In certain embodiments, the length of the first compensation transistor is the same as the length of the second compensation transistor and the width of the first compensation transistor is different from the width of the second compensation transistor.

In certain embodiments, the plurality of light-emitter circuits includes a first light-emitter circuit having a first light emitter, a second light-emitter circuit having a second light emitter, and a third light-emitter circuit having a third light emitter, the distance from the first light emitter to the second light emitter is a first distance, the distance from the first light emitter to the third light emitter is a second distance, and the first distance is different from the second distance.

In certain embodiments, the first light-emitter circuit includes a first compensation transistor having a drain connected to the emitter connection of the second light-emitter circuit and a second compensation transistor having a drain connected to the emitter connection of the third light-emitter circuit, and wherein the ratio of the first distance to the second distance is inversely proportional to the ratio of the size of the first compensation transistor to the size of the second compensation transistor.

In certain embodiments, the ratio of the first distance to the second distance is 1:1.414.

In certain embodiments, the plurality of light-emitter circuits includes:

a first light-emitter circuit having a first light emitter;

a second light-emitter circuit having a second light emitter;

a third light-emitter circuit having a third light emitter;

a fourth light-emitter circuit having a fourth light emitter;

a fifth light-emitter circuit having a fifth light emitter;

a sixth light-emitter circuit having a sixth light emitter;

a seventh light-emitter circuit having a seventh light emitter;

an eighth light-emitter circuit having an eighth light emitter;

a ninth light-emitter circuit having a ninth light emitter;

the first light-emitter circuit includes a first compensation transistor having a drain connected to the emitter connection of the second light-emitter circuit, a second compensation transistor having a drain connected to the emitter connection of the third light-emitter circuit, a third compensation transistor having a drain connected to the emitter connection of the fourth light-emitter circuit, a fourth compensation transistor having a drain connected to the emitter connection of the fifth light-emitter circuit, a fifth compensation transistor having a drain connected to the emitter connection of the sixth light-emitter circuit, a sixth compensation transistor having a drain connected to the emitter connection of the seventh light-emitter circuit, a seventh compensation transistor having a drain connected to the emitter connection of the eighth light-emitter circuit, and an eighth compensation transistor having a drain connected to the emitter connection of the ninth light-emitter circuit; wherein the first through ninth light emitters are arranged in a three-by-three array with the first light emitter in the center, the second and third light emitters in a common row with the first light emitter and on either side of the first light emitter, the fourth and fifth light emitters in a common column with the first light emitter and on either side of the first light emitter, and the sixth, seventh, eighth, and ninth light emitters each in a row and in a column adjacent to the first light emitter; herein the second through fifth light emitters have a first common size and the sixth through ninth light emitters have a second common size different from the first common size.

In certain embodiments, the ratio of the first common size to the second common size is 1.414:1.

In another aspect, the disclosed technology includes a self-compensating circuit for controlling pixels in a display, including: a plurality of light-emitter circuits, each light-emitter circuit including: a light emitter having a power connection to a power supply and an emitter connection; a control transistor having a gate and a drain connected to the emitter connection and a source connected to a compensation connection; a drive transistor having a gate connected to a drive signal, a drain connected to the compensation connection, and a source connected to a ground; one or more compensation transistors, each compensation transistor having a gate connected to a bias connection, a source connected to the compensation connection, and a drain, wherein the number of compensation transistors in each light-emitter circuit is one fewer than the number of light emitters in the self-compensating circuit and the drain of each compensation transistor in each light-emitter circuit is connected to the emitter connection of each of one or more light-emitter circuits other than the light-emitter circuit of which the compensation transistor is a part, thereby emitting compensatory light from the one or more light-emitter circuits when the light emitter is faulty.

In certain embodiments, wherein the light emitters are inorganic light-emitters.

In certain embodiments, the inorganic light emitters are inorganic light-emitting diodes.

In certain embodiments, the compensation transistors in a light-emitter circuit have a size equal to or smaller than the control transistor.

In certain embodiments, the size of the compensation transistors in a light-emitter circuit is inversely related to the number of compensation transistors in the light-emitter circuit.

In certain embodiments, the size of the compensation transistors in a light-emitter circuit is less than or equal to the size of the control transistor divided by the number of compensation transistors.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In certain embodiments, the disclosed technology includes a self-compensating display, including an array of light emitters forming rows and columns on a display substrate, each light emitter controlled by the self-compensating circuit.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein the drain of each compensation transistor in a light-emitter circuit is connected to a different one of the other emitter connections in the light-emitter circuits of the other light emitters in the exclusive group.

In certain embodiments, the number of compensation transistors in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein the source of each compensation transistor in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitters having a left light emitters to the left of the central light emitters, a right light emitters to the right of the central light emitters, an upper light emitters above the central light emitters, and a lower light emitters below the central light emitters.

In certain embodiments, each group of adjacent pixels comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter. In certain embodiments, the display includes an inverter connecting the emitter connection of the light emitter to the bias connection of each of the one or more compensation transistors.

In certain embodiments, the inverter incorporates a CMOS transistor, a CMOS inverter, or a p-channel transistor connected in series with an n-channel transistor.

In certain embodiments, the one or more compensation transistors includes at least a first compensation transistor and a second compensation transistor different from the first compensation transistor and wherein the first and second compensation transistors have different sizes.

In certain embodiments, the length of the first compensation transistor is the same as the length of the second compensation transistor and the width of the first compensation transistor is different from the width of the second compensation transistor.

In certain embodiments, the plurality of light-emitter circuits includes a first light-emitter circuit having a first light emitter, a second light-emitter circuit having a second light emitter, and a third light-emitter circuit having a third light emitter, the distance from the first light emitter to the second light emitter is a first distance, the distance from the first light emitter to the third light emitter is a second distance, and the first distance is different from the second distance.

In certain embodiments, the first light-emitter circuit includes a first compensation transistor having a drain connected to the emitter connection of the second light-emitter circuit and a second compensation transistor having a drain connected to the emitter connection of the third light-emitter circuit, and wherein the ratio of the first distance to the second distance is inversely proportional to the ratio of the size of the first compensation transistor to the size of the second compensation transistor.

In certain embodiments, the ratio of the first distance to the second distance is 1:1.414.

In certain embodiments, the plurality of light-emitter circuits includes:

a first light-emitter circuit having a first light emitter;

a second light-emitter circuit having a second light emitter;

a third light-emitter circuit having a third light emitter;

a fourth light-emitter circuit having a fourth light emitter;

a fifth light-emitter circuit having a fifth light emitter;

a sixth light-emitter circuit having a sixth light emitter;

a seventh light-emitter circuit having a seventh light emitter;

an eighth light-emitter circuit having an eighth light emitter;

a ninth light-emitter circuit having a ninth light emitter;

the first light-emitter circuit includes a first compensation transistor having a drain connected to the emitter connection of the second light-emitter circuit, a second compensation transistor having a drain connected to the emitter connection of the third light-emitter circuit, a third compensation transistor having a drain connected to the emitter connection of the fourth light-emitter circuit, a fourth compensation transistor having a drain connected to the emitter connection of the fifth light-emitter circuit, a fifth compensation transistor having a drain connected to the emitter connection of the sixth light-emitter circuit, a sixth compensation transistor having a drain connected to the emitter connection of the seventh light-emitter circuit, a seventh compensation transistor having a drain connected to the emitter connection of the eighth light-emitter circuit, and an eighth compensation transistor having a drain connected to the emitter connection of the ninth light-emitter circuit; wherein the first through ninth light emitters are arranged in a three-by-three array with the first light emitter in the center, the second and third light emitters in a common row with the first light emitter and on either side of the first light emitter, the fourth and fifth light emitters in a common column with the first light emitter and on either side of the first light emitter, and the sixth, seventh, eighth, and ninth light emitters each in a row and in a column adjacent to the first light emitter; herein the second through fifth light emitters have a first common size and the sixth through ninth light emitters have a second common size different from the first common size.

In certain embodiments, the ratio of the first common size to the second common size is 1.414:1.

In another aspect, the disclosed technology includes a self-compensating circuit for controlling pixels in a display, including: a plurality of light-emitter circuits, each light-emitter circuit including: a light emitter having a power connection to a power supply and an emitter connection; a control transistor having a gate and a drain connected to the emitter connection and a source connected to a compensation connection; a drive transistor having a gate connected to a drive signal, a drain connected to the compensation connection, and a source connected to a ground; and a compensation transistor having a gate connected to a bias connection, a source connected to the compensation connection, and a drain connected to a common compensation connection; a transfer transistor having a gate and a drain connected to the emitter connection and a source connected to the common compensation connection, wherein the common compensation connection of each of the plurality of light-emitter circuits is electrically connected in common.

In certain embodiments, wherein the light emitters are inorganic light-emitters.

In certain embodiments, the inorganic light emitters are inorganic light-emitting diodes.

In certain embodiments, the compensation transistors in a light-emitter circuit have a size equal to or smaller than the control transistor.

In certain embodiments, the size of the compensation transistors in a light-emitter circuit is inversely related to the number of compensation transistors in the light-emitter circuit.

In certain embodiments, the size of the compensation transistors in a light-emitter circuit is less than or equal to the size of the control transistor divided by the number of compensation transistors.

In certain embodiments, the light emitter is a light-emitting diode with a width from 2 to 5 μm, 5 to 10 μm, 10 to 20 μm, or 20 to 50 μm.

In certain embodiments, the light emitter is a light-emitting diode with a length from 2 to 5 μm, 5 to 10 μm, 10 to 20 μm, or 20 to 50 μm.

In certain embodiments, the light emitter is a light-emitting diode with a height from 2 to 5 μm, 4 to 10 μm, 10 to 20 μm, or 20 to 50 μm.

In certain embodiments, the disclosed technology includes a self-compensating display, including an array of light emitters forming rows and columns on a display substrate, each light emitter controlled by the self-compensating circuit.

In certain embodiments, the display substrate is a polymer, plastic, resin, polyimide, PEN, PET, metal, metal foil, glass, a semiconductor, or sapphire.

In certain embodiments, the light emitters are arranged in exclusive groups of adjacent light emitters so that each light emitter is a member of only one group and wherein the drain of each compensation transistor in a light-emitter circuit is connected to a different one of the other emitter connections in the light-emitter circuits of the other light emitters in the exclusive group.

In certain embodiments, the number of compensation transistors in each light-emitter circuit is equal to one less than the number of light emitters in the exclusive group.

In certain embodiments, each group of adjacent light emitters comprises two light emitters located in adjacent rows.

In certain embodiments, each group of adjacent light emitters comprises two light emitters located in adjacent columns.

In certain embodiments, each group of adjacent light emitters comprises four light emitters located in a two by two array forming two rows and two columns.

In certain embodiments, each group of adjacent light emitters is located on a pixel substrate that is independent and separate from the display substrate and the pixel substrates are mounted on the display substrate.

In certain embodiments, each light emitter is located on a pixel substrate that is independent and separate from the display substrate and the pixel substrates are mounted on the display substrate.

In certain embodiments, the light emitters are arranged in groups of adjacent light emitters and wherein the source of each compensation transistor in each light-emitter circuit is connected to a different one of the emitter connections in the light-emitter circuits of each light emitter in the group.

In certain embodiments, at least one group of light emitters overlaps another group of light emitters so that at least one light emitter is a member of more than one group.

In certain embodiments, each group of adjacent light emitters comprises five light emitters, the five light emitters arranged with a central light emitters having a left light emitters to the left of the central light emitters, a right light emitters to the right of the central light emitters, an upper light emitters above the central light emitters, and a lower light emitters below the central light emitters.

In certain embodiments, each group of adjacent pixels comprises nine light emitters, the nine light emitters arranged with a central light emitter having a light emitter above the central light emitter, a light emitter below the central light emitter, a light emitter on the left side of the central light emitter, a light emitter on the right side of the central light emitter, a light emitter on the upper left of the central light emitter, a light emitter on the upper right of the central light emitter, a light emitter on the lower left of the central light emitter, and a light emitter on the lower right of the central light emitter. In certain embodiments, the display includes an inverter connecting the emitter connection of the light emitter to the bias connection of each of the one or more compensation transistors.

In certain embodiments, the inverter incorporates a CMOS transistor, a CMOS inverter, or a p-channel transistor connected in series with an n-channel transistor.

In certain embodiments, the one or more compensation transistors includes at least a first compensation transistor and a second compensation transistor different from the first compensation transistor and wherein the first and second compensation transistors have different sizes.

In certain embodiments, the length of the first compensation transistor is the same as the length of the second compensation transistor and the width of the first compensation transistor is different from the width of the second compensation transistor. In certain embodiments, the plurality of light-emitter circuits includes a first light-emitter circuit having a first light emitter, a second light-emitter circuit having a second light emitter, and a third light-emitter circuit having a third light emitter, the distance from the first light emitter to the second light emitter is a first distance, the distance from the first light emitter to the third light emitter is a second distance, and the first distance is different from the second distance.

In certain embodiments, the first light-emitter circuit includes a first compensation transistor having a drain connected to the emitter connection of the second light-emitter circuit and a second compensation transistor having a drain connected to the emitter connection of the third light-emitter circuit, and wherein the ratio of the first distance to the second distance is inversely proportional to the ratio of the size of the first compensation transistor to the size of the second compensation transistor.

In certain embodiments, the ratio of the first distance to the second distance is 1:1.414.

In certain embodiments, the plurality of light-emitter circuits includes:

a first light-emitter circuit having a first light emitter;

a second light-emitter circuit having a second light emitter;

a third light-emitter circuit having a third light emitter;

a fourth light-emitter circuit having a fourth light emitter;

a fifth light-emitter circuit having a fifth light emitter;

a sixth light-emitter circuit having a sixth light emitter;

a seventh light-emitter circuit having a seventh light emitter;

an eighth light-emitter circuit having an eighth light emitter;

a ninth light-emitter circuit having a ninth light emitter;

the first light-emitter circuit includes a first compensation transistor having a drain connected to the emitter connection of the second light-emitter circuit, a second compensation transistor having a drain connected to the emitter connection of the third light-emitter circuit, a third compensation transistor having a drain connected to the emitter connection of the fourth light-emitter circuit, a fourth compensation transistor having a drain connected to the emitter connection of the fifth light-emitter circuit, a fifth compensation transistor having a drain connected to the emitter connection of the sixth light-emitter circuit, a sixth compensation transistor having a drain connected to the emitter connection of the seventh light-emitter circuit, a seventh compensation transistor having a drain connected to the emitter connection of the eighth light-emitter circuit, and an eighth compensation transistor having a drain connected to the emitter connection of the ninth light-emitter circuit; wherein the first through ninth light emitters are arranged in a three-by-three array with the first light emitter in the center, the second and third light emitters in a common row with the first light emitter and on either side of the first light emitter, the fourth and fifth light emitters in a common column with the first light emitter and on either side of the first light emitter, and the sixth, seventh, eighth, and ninth light emitters each in a row and in a column adjacent to the first light emitter; herein the second through fifth light emitters have a first common size and the sixth through ninth light emitters have a second common size different from the first common size.

In certain embodiments, the ratio of the first common size to the second common size is 1.414:1.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIG. 5 is a prior-art illustration of a transistor useful in understanding the present invention;

FIG. 6 is an illustration of a display having pixels arranged in accordance with embodiments of the present invention;

Figure 1:
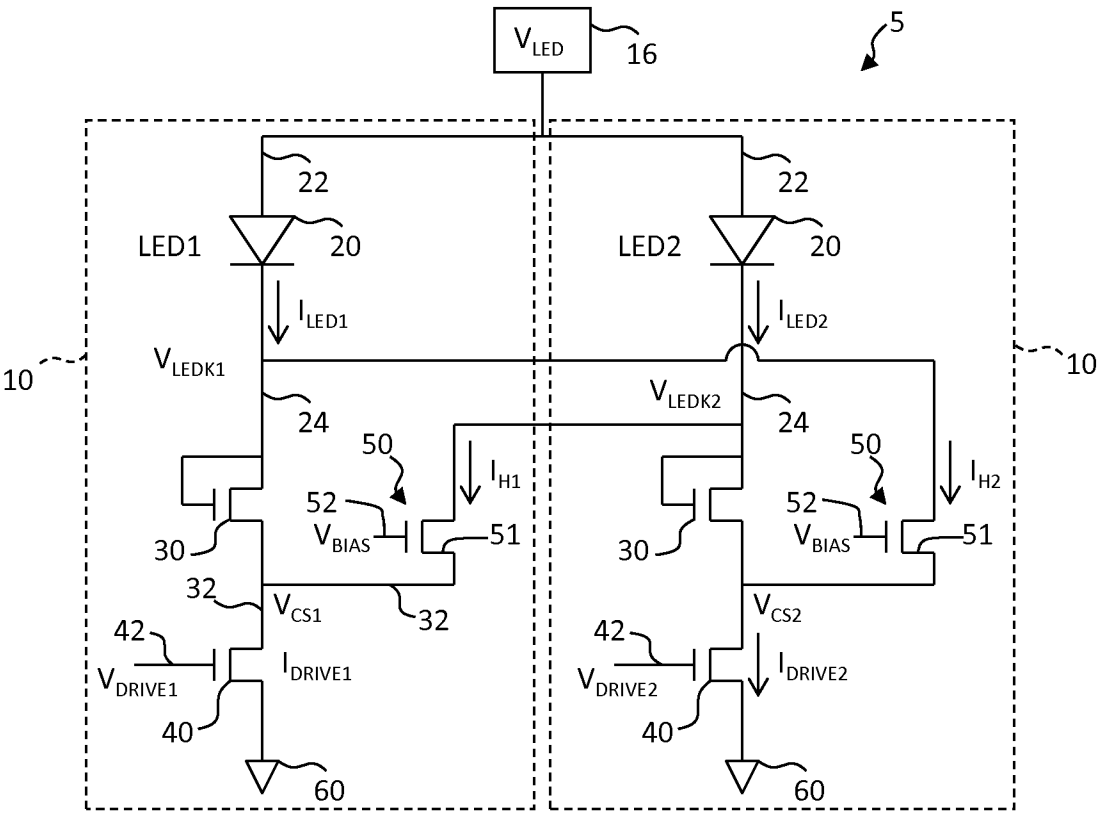
FIG. 1 is a schematic illustration of an embodiment of the present invention including two light-emitter circuits.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 4:
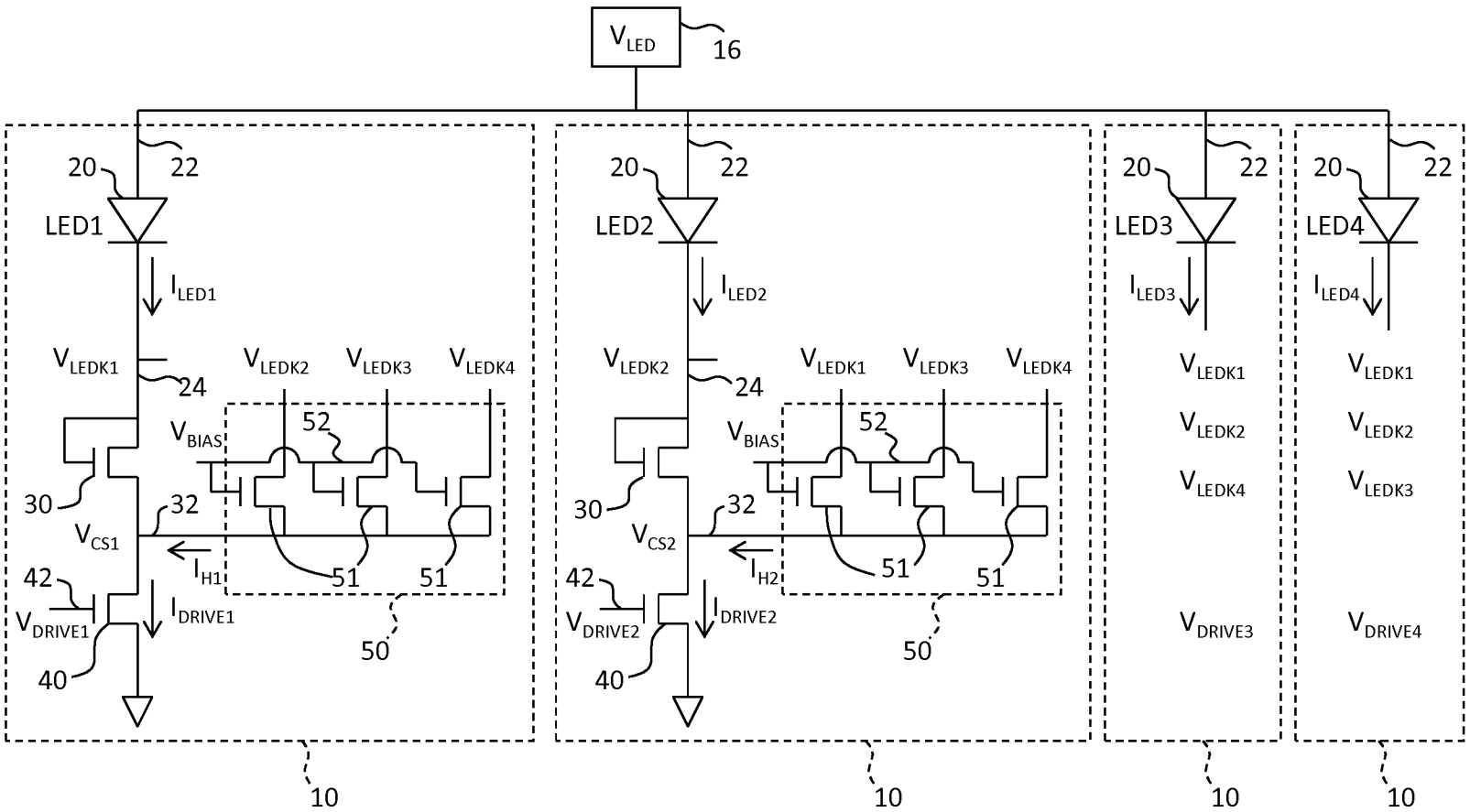
FIG. 4 is a schematic illustration of an embodiment of the present invention including four light-emitter circuits.

FIG. 1 is a schematic circuit diagram illustrating an embodiment of the present invention having two light emitters 20 in a self-compensating circuit 5 of the present invention. FIG. 4 is a schematic representation of an embodiment of the present invention having four light emitters 20 in the self-compensating circuit 5 of the present invention. The light emitters 20 are light-emitting elements in a self-compensating display 4 having an array of pixels 70, for example as shown in FIG. 6. Each of the light emitters 20 in FIGS. 1 and 4 corresponds to a pixel 70 or a sub-pixel of the self-compensating display 4. As used herein, a light emitter 20 can be a pixel or a light-emitting element of a pixel, for example a sub-pixel.

Referring to the embodiment of both FIGS. 1 and 4, the self-compensating circuit 5 for controlling pixels 70 in a display includes a plurality of light-emitter circuits 10. Each light-emitter circuit 10 includes a light emitter 20 having a power connection 22 to a power supply 16 and an emitter connection 24. The light emitter 20 can be a light-emitting diode and the power and emitter connections 22, 24 are the electrical connections to the light emitter 20 and are appropriately connected to permit current to flow through the light emitter 20 to emit light from the light emitter 20 when a suitable voltage is applied across the power and emitter connections 22, 24. The electrical connections as described herein can be, for example, metal wires, sintered metal particles, metal oxides, or other materials that conduct electricity.

An insulated gate field-effect control transistor 30 has a gate and a drain connected to the emitter connection 24 and a source connected to a compensation connection 32. A drive transistor 40 has a gate connected to a drive signal 42, a drain connected to the compensation connection 32, and a source connected to a ground 60. Transistors are very well known and all variants of transistors may be used in the circuits, such as metal-oxide field effect transistors (MOSFETs), bipolar junction transistors (BJTs), junction field-effect transistors (JFETs), and others. Referring briefly to prior-art FIG. 5, a transistor 90 includes a drain 91, a source 92, and a gate 93 that controls the flow of current from the drain 91 to the source 93 through the transistor 90 (or vice versa depending on the nomenclature used or transistor type). Transistors 90 useful in the present invention can be made in crystalline semiconductors such as silicon or in thin films of amorphous or polysilicon coated on a substrate such as a display substrate.

Each light-emitter circuit 10 includes a compensation circuit 50 that has one or more compensation transistors 51 each having a gate connected to a bias connection 52, a source connected to the compensation connection 32, and a drain. In different embodiments of the present invention, different compensation circuits 50 include different numbers of compensation transistors 51. In the embodiment of FIGS. 1 and 4, the number of compensation transistors 51 in each light-emitter circuit 10 is one fewer than the number of light emitters 20 in the self-compensating circuit 5. The example of FIG. 1 has two light emitters 20 and therefore only one compensation transistor 51 in each light-emitter circuit 10 of the self-compensating circuit 5. The example of FIG. 4 has four light emitters 20 and therefore only three compensation transistors 51 in each light-emitter circuit 10 of the self-compensating circuit 5. The drain of each compensation transistor 51 in each light-emitter circuit 10 is connected to the emitter connection 24 of a light-emitter circuit 10 other than the light-emitter circuit 10 of which the compensation transistor 51 is a part.

In an embodiment of the present invention, the light emitters 20 are inorganic light-emitters such as inorganic light-emitting diodes.

In FIG. 1, the light emitters 20 are labeled "LED1" and "LED2," respectively. Thus, the drain of the compensation transistor 51 in the light-emitter circuit 10 corresponding to LED1 is connected to the emitter connection 24 of the light-emitter circuit 10 corresponding to LED2. Similarly, the drain of the compensation transistor 51 in the light-emitter circuit 10 corresponding to LED2 is connected to the emitter connection 24 of the light-emitter circuit 10 corresponding to LED1. The light-emitter circuit 10 including LED1 is a different light-emitter circuit 10 from and is another light-emitter circuit 10 than the light-emitter circuit 10 that includes LED2.

In FIG. 4, the light emitters 20 are labeled "LED1," "LED2," "LED3," and "LED4," respectively. As noted above, there are therefore three compensation transistors 51 in each light-emitter circuit 10. (For clarity, in FIG. 4 the light-emitter circuits 10 for LEDs 3 and 4 and the wiring for the emitter connections 24 to the compensation transistors 51 are not shown.) The drain of each compensation transistor 51 is directly connected to a different emitter connection 24 in another light-emitter circuit 10. Thus, the drains of the compensation transistors 51 of the light-emitter circuit 10 including LED1 are connected to the emitter connections 24 of the light-emitter circuits 10 including LED2, LED3, and LED4, respectively. The drains of the compensation transistors 51 of the light-emitter circuit 10 including LED2 are connected to the emitter connections 24 of the light-emitter circuits 10 including LED1, LED3, and LED4, respectively. The drains of the compensation transistors 51 of the light-emitter circuit 10 including LED3 are connected to the emitter connections 24 of the light-emitter circuits 10 including LED1, LED2, and LED4, respectively. The drains of the compensation transistors 51 of the light-emitter circuit 10 including LED4 are connected to the emitter connections 24 of the light-emitter circuits 10 including LED1, LED2, and LED3, respectively. For clarity, in the circuit FIGS. 1-4, the emitter connection 24 of the light-emitter circuit 10 including LED1 is labeled $V_{LEDK1}$, the emitter connection 24 of the light-emitter circuit 10 including LED2 is labeled $V_{LEDK2}$, the emitter connection 24 of the light-emitter circuit 10 including LED3 is labeled $V_{LEDK3}$, and the emitter connection 24 of the light-emitter circuit 10 including LED4 is labeled $V_{LEDK4}$. The "LEDK" nomenclature refers to the voltage of the LED cathode. Similarly, the drive signals 42 of each of the light-emitter circuits 10 are labeled $V_{DRIVE}$ with a suffix corresponding to the LED of the light-emitter circuit 10 of which it is a part. The compensation connection 32 is labeled as $V_{CS}$. Other elements of the light-emitter circuits 10 are similarly labeled with suffixes corresponding to the LED of the light-emitter circuit 10 of which they are a part.

Figure 2:
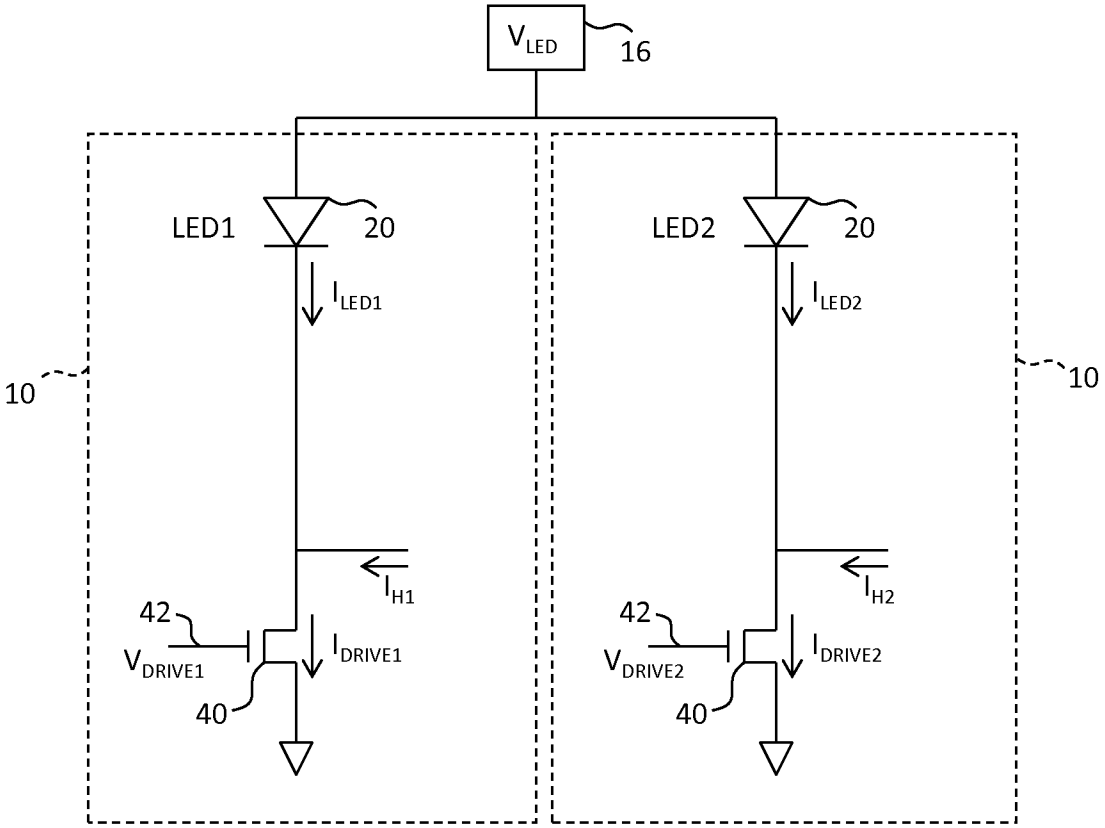
FIG. 2 is an equivalent circuit schematic illustration of the FIG. 1 circuit in a non-compensation mode.
Figure 3:
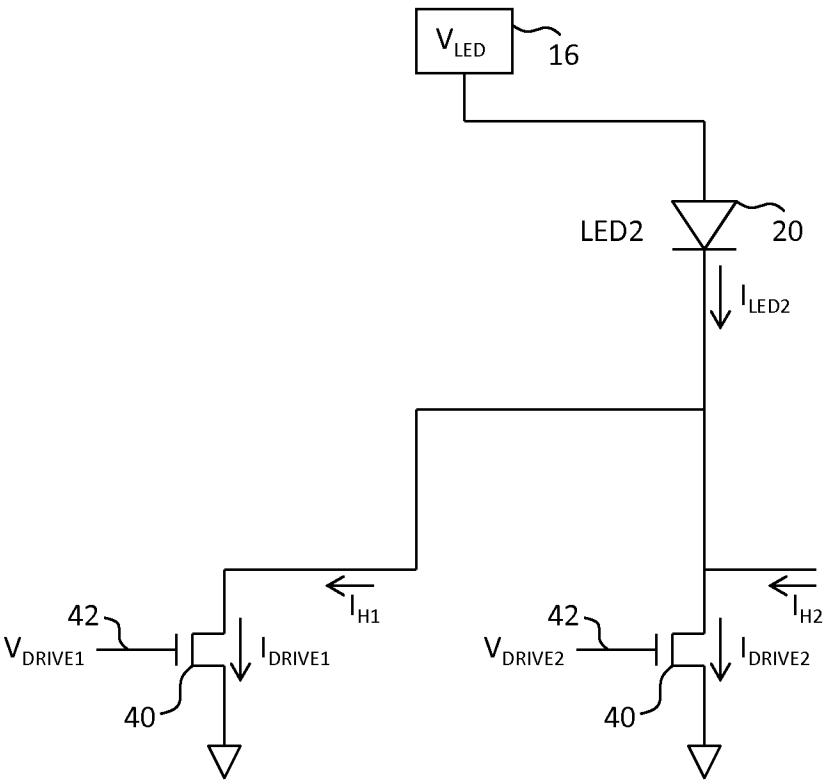
FIG. 3 is an equivalent circuit schematic illustration of the FIG. 1 circuit in a compensation mode.

In operation, the compensation transistors 51 of each light-emitter circuit 10 act as switches that operate in response to current flowing through the LED of the light-emitter circuit 10. When no fault is present, the compensation transistors 51 of the same light-emitter circuit 10 are effectively in an OFF state and current $I_{LED}$ flows through the corresponding LED. In this case, current $I_H$ is zero and current $I_{DRIVE}$ is equal to current $I_{LED}$. FIG. 2 illustrates the equivalent circuit corresponding to the OFF state of compensation transistor 51. As shown in FIG. 2, the compensation transistor 51 turns off so that each of the light-emitter circuits 10 acts independently to control current $I_{LED}$ from the power supply 16 to flow through each LED light emitter 20 in response to the $V_{DRIVE}$ drive signal 42 controlling the drive transistor 40.

In the case of a fault, for example corresponding to a case in which an LED is missing or defective, the compensation transistors 51 of the same light-emitter circuit 10 as the faulty LED are effectively in an ON state. Referring to the equivalent circuit corresponding to the ON state illustrated in FIG. 3 in which LED1 is missing or defective, the compensation transistor 51 turns on to pass current $I_{LED2}$ from the power supply 16 through LED2 corresponding to the sum of the drive currents $I_{DRIVE1}$ and $I_{DRIVE2}$ controlled by the $V_{DRIVE1}$ and $V_{DRIVE2}$ drive signals 42. In this case, current $I_{DRIVE1}$ is equal to current $I_{H1}$ and current $I_{LED2}$ is equal to $I_{DRIVE1}$ plus $I_{DRIVE2}$. Thus, LED2 will emit more light, compensating for the lack of light output by defective light emitter 20 LED1.

The four-light-emitter self-compensating circuit 5 of FIG. 4 operates in the same fashion as the two-light-emitter self-compensating circuit 5 of FIG. 1. If there is no fault, the compensation transistors 51 are in an OFF state, current flows through the light-emitters 20 normally, current $I_{DRIVE}$ is equal to current $I_{LED}$ and current $I_H$ equals zero, and the drive transistors 40 of the light-emitter circuits 10 effectively act independently to control the light output by light-emitters 20 in each light-emitter circuit 10 in response to the $V_{DRIVE}$ drive signals 42.

If a fault is present in a light-emitter circuit 10, the compensation transistors 51 in the faulty light-emitter circuit 10 will turn on and current will flow from each of the other light-emitter circuits 10 through the drive transistor 40 of that light-emitter circuit 10 corresponding to the $V_{DRIVE}$ drive signal 42. In the faulty light-emitter circuit 10, current $I_{LED}$ is zero and current $I_{DRIVE}$ is equal to current $I_H$. The $I_H$ current is shared among the compensation transistors 51 in the faulty light-emitter circuit 10 and is derived from the emitter connections 24 of the good light-emitter circuits 10. This will have the effect of increasing the $I_{LED}$ current through each of the LEDs in the other light-emitter circuits 10, so that each of the other LEDs emit more light to compensate for the light missing from the faulty LED.

This self-compensating circuit 5 will continue to work even if two or more light-emitter circuits 10 have faulty light emitters 20 as long as at least one light-emitting circuit 10 is functional. The drive transistors 40 of each of the light-emitter circuits 10 having faulty light emitters 20 will continue to pull current $I_{DRIVE}$ corresponding to their $V_{DRIVE}$ drive signals 42. This will increase the current $I_{LED}$ through the functioning light emitters 20 and increase their brightness to compensate for the faulty light emitters 20.

An important factor in the present invention is the operation of the compensation transistors 51 with respect to the control transistors 30. When the LED of a light-emitter circuit 10 is operating normally throughout its entire operating range, the compensation transistors 51 are turned off. When the LED of a light-emitter circuit 10 is missing or defective, the compensation transistors 51 turn on to provide a compensating current flow through the LEDs of the other light-emitter circuits 10. Switching the compensation transistors 51 from the ON state to the OFF state or vice versa is achieved by setting the $V_{BIAS}$ voltage of the bias connection 52 on the gate of the compensation transistors 51 to a voltage between the voltage of the emitter connection 24 (essentially $V_{LEDK}$) and the voltage of the compensation connection 32 on the source of the drive transistor 40 and the drain of the control transistor 30.

When the LED of a light-emitter circuit 10 is operating normally throughout its entire operating range, the drain current of the control transistor 30 is equal to the drain current of the drive transistor 40. For a given dimension of the control transistor 30, there is an associated gate-to-source voltage $V_{GS}$(max) for the control transistor 30 for a given maximum drive current $I_{DRIVE1}$. In the case of FIG. 1, if the compensation transistor 51 has the same dimensions as the control transistor 30, then the compensation transistor 51 will achieve the same maximum current and same $V_{GS}$(max) as the control transistor 30 when the LED of a light-emitter circuit 10 is missing or defective. If the current in either the control transistor 30 or the compensation transistor 51 is at zero or at leakage levels, the associated transistor gate-to-source voltage approaches the transistor threshold voltage $V_T$.

$V_{LEDK}$ is connected to the gate of the control transistor 30 and the $V_{BIAS}$ bias connection 52 is connected to the gate of the compensation transistor 51. When the LED of a light-emitter circuit 10 is operating normally throughout its entire operating range, the voltage $V_{LEDK}$ is defined as being less than the power supply 16 $V_{LED}$ by the LED forward voltage drop $V_{LEDFWD}$. In this condition, the voltage at $V_{CS}$ 32 equals $V_{LEDK}$ 24 minus $V_{GS}$(ON). For the control transistor 30 to pass all of the current from the drive transistor 40 and for compensation transistor 51 to pass no current, $V_{BIAS}$ is defined as less than $V_{CS}$ 32 plus $V_T$.

When the LED of a light-emitter circuit 10 is missing or defective, the LED can no longer support the current $I_{DRIVE}$ and the voltage $V_{LEDK}$ 24 will drop towards the voltage level of the ground 60 due to current pull-down action by the drive transistor 40. In this condition, $V_{CS}$ 32 equals $V_{BIAS}$ minus $V_{GS}$(ON). When voltage $V_{LEDK}$ 24 is less than $V_{CS}$ 32 plus $V_T$, then compensation transistor 51 conducts all drive current from the drive transistor 40 and the control transistor 30 no longer conducts current.

An embodiment of the present invention was simulated to demonstrate its performance. In this simulation, a resistor Rled was placed in series with the LED1 light emitter 20 and the resistance of the resistor varied from 100Ω to 10 GΩ to simulate the effect of a functioning light emitter 20 at low resistance and a missing or defective light emitter 20 at high resistance. An additional diode-connected transistor having a drain connected to the $V_{BIAS}$ bias connection 52 and source connected to ground 60 to provide a suitable $V_{BIAS}$ value was added to the circuit of FIG. 1, together with an additional diode-connected transistor having a drain connected to the $V_{DRIVE}$ drive signal 42 and source connected to ground 60 to provide a suitable $V_{DRIVE}$ value.

Figure 17:
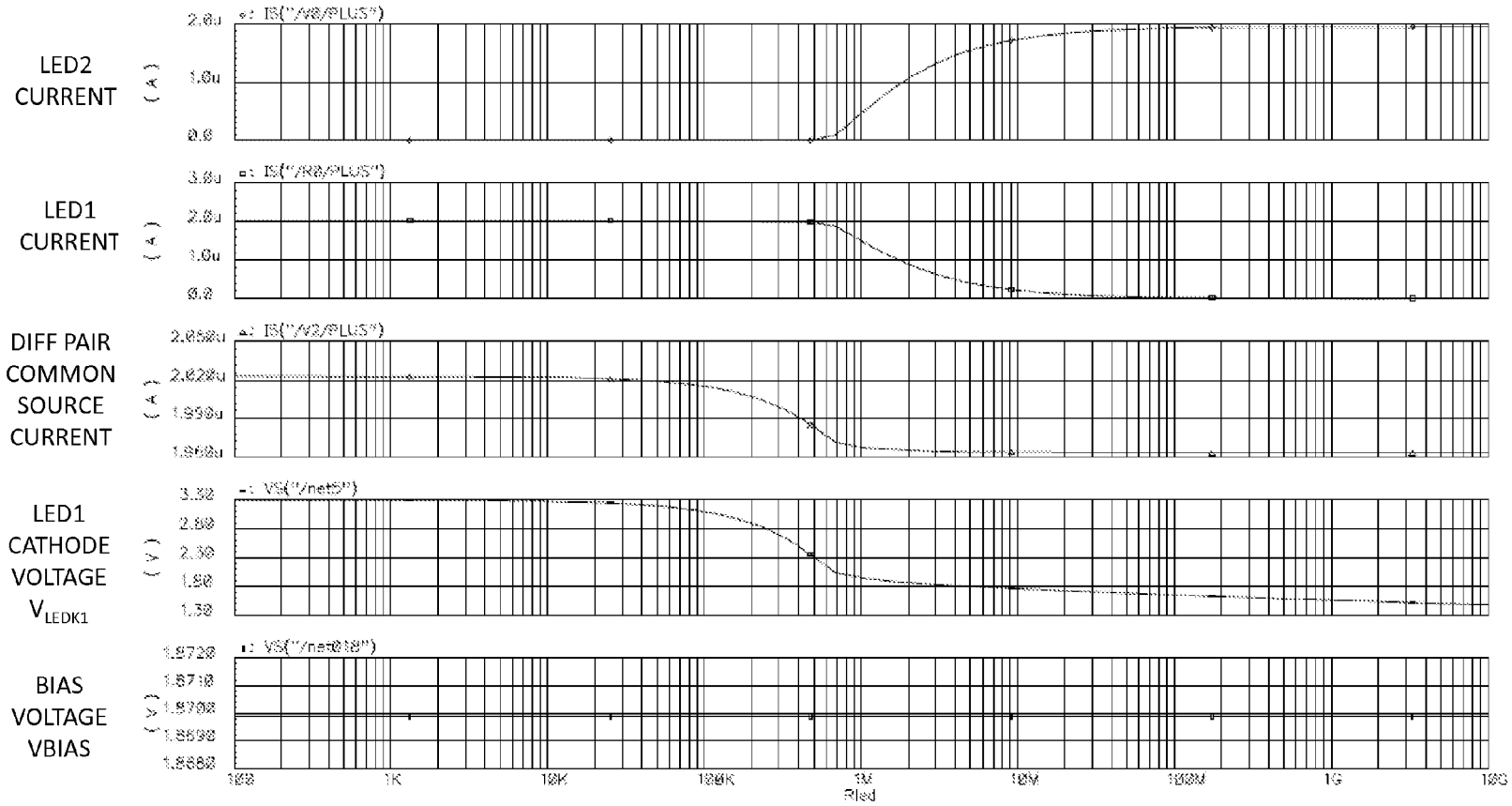
FIG. 17 is a graph illustrating the performance of an embodiment of the present invention.

FIG. 17 illustrates the simulated performance of the circuit in FIG. 1. In this simulation, the $V_{DRIVE2}$ drive signal 42 for LED2 is set to zero and the $V_{BIAS}$ voltage is set to 1.87 volts. As shown in FIG. 17, when the resistance of the LED1 resistor is low (Rled=100Ω-10 kΩ and LED1 is functioning normally), the LED2 current is zero, the LED1 current is high at 2 μA, and $V_{LEDK1}$ is also high at 3.3 V. Thus, LED1 emits light and LED2 does not, as desired. In contrast, if the LED1 resistor is high (Rled=100MΩ-10 GΩ and LED1 is missing or at high resistance), the LED2 current is high at 2 μA, the LED1 current is zero, and $V_{LEDK1}$ is low at less than 1.8 V. Thus, LED2 emits light and LED1 does not, demonstrating that LED2 is emitting light in place of the missing or defective LED1.

Figure 18:
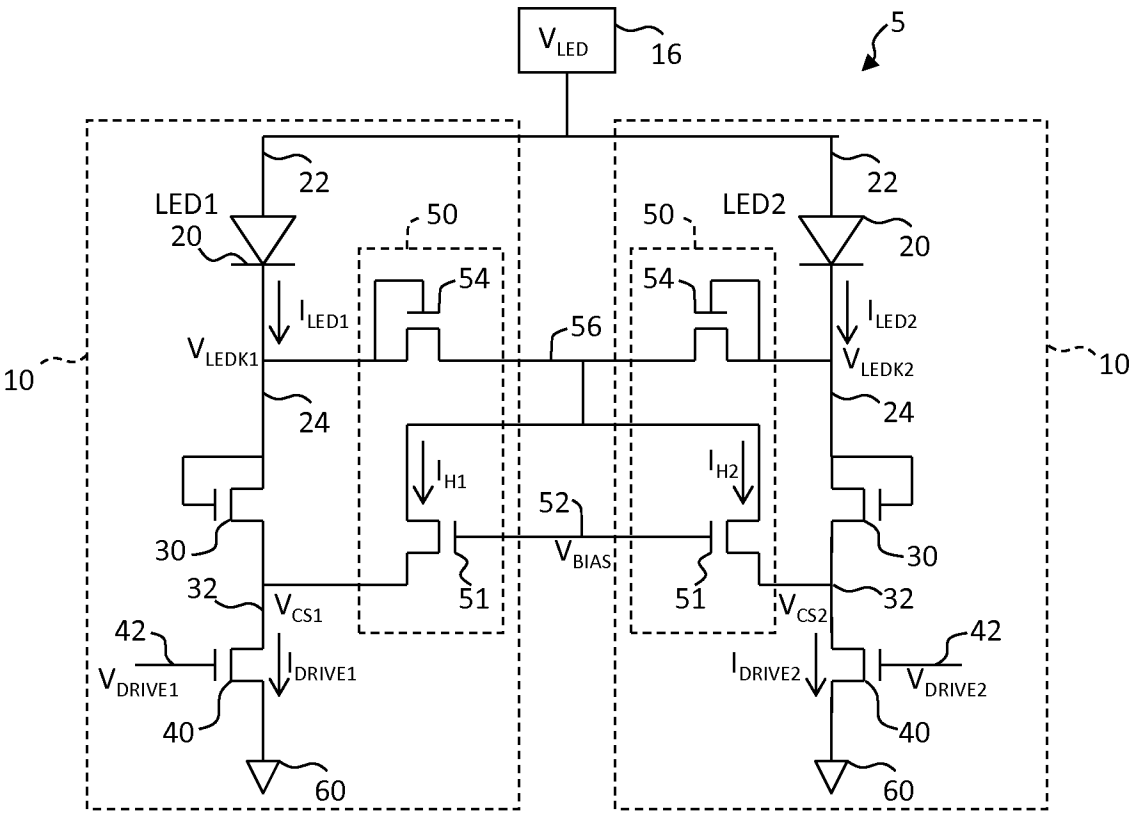
FIG. 18 is a schematic illustration of an alternative embodiment of the present invention including a common compensation connection.
Figure 19:
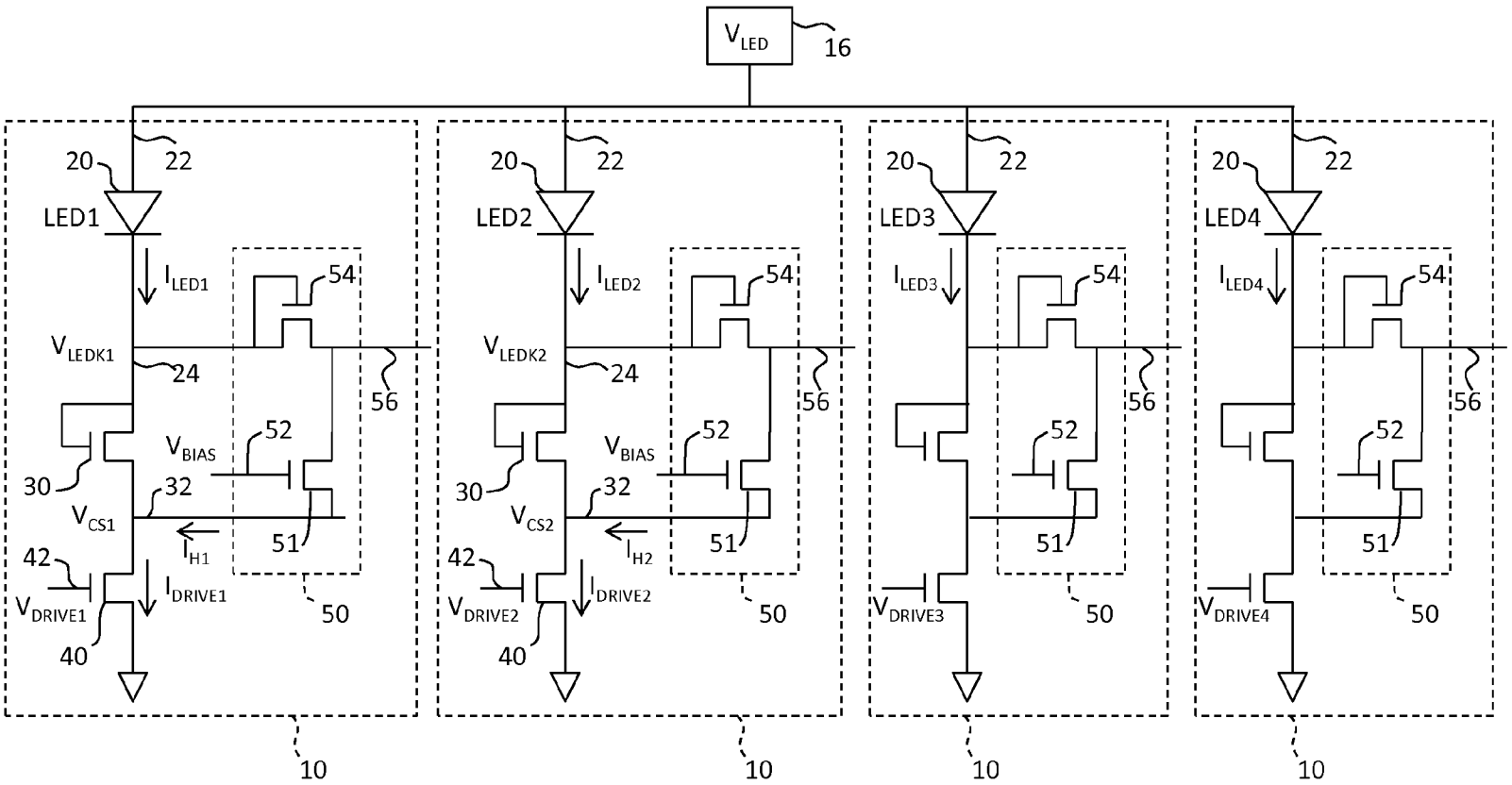
FIG. 19 is a schematic illustration of an embodiment of the present invention including four light-emitter circuits and a common compensation connection.

Referring next to the alternative embodiment illustrated in FIGS. 18 and 19, corresponding to FIGS. 1 and 4, a self-compensating circuit 5 includes a plurality of the light-emitter circuits 10, each light-emitter circuit 10 having a light emitter 20, a control transistor 30, a drive transistor 40, and a compensation circuit 50 connected as described above with respect to FIGS. 1 and 4. However, in the embodiment of FIGS. 18 and 19, the compensation circuit 50 in each light-emitter circuit 10 has only one compensation transistor 51. As in FIGS. 1 and 4, the compensation transistor 51 has a gate connected to a bias connection 52, a source connected to the compensation connection 32, and a drain.

In addition to the compensation transistor 51, each compensation circuit 50 in FIGS. 18 and 19 includes one transfer transistor 54 having a gate and a drain connected to the emitter connection 24 and a source connected to a common compensation connection 56. The common compensation connection 56 is connected to the drain of the compensation transistor 51. Thus, the drain of each compensation transistor 51 in each light-emitter circuit 10 is connected to the emitter connection 24 of one or more different light-emitter circuits 10. For clarity, only one of the compensation circuits 50 is indicated in FIG. 18.

In the embodiment of FIGS. 1 and 4, the drain of each compensation transistor 51 in each light-emitter circuit 10 is directly connected to the emitter connection 24 of one or more different light-emitter circuits 10. In contrast, in the embodiment of FIGS. 18 and 19, the drain of each compensation transistor 51 in each light-emitter circuit 10 is indirectly connected to the emitter connection 24 through the transfer transistor 54 but, as intended herein, the drain of each compensation transistor 51 in each light-emitter circuit 10 is connected to the emitter connection 24 of one or more different light-emitter circuits 10.

The common compensation connection 56 of each light-emitter circuit 10 is also electrically connected in common. The source of each and every transfer transistor 54 and the source of each and every compensation transistor 51 of the compensation circuit 50 of every light-emitter circuit 10 in the self-compensating circuit 5 are electrically connected together. For clarity, in FIG. 19 the common compensation connection 56 is not explicitly shown as connected, but the wire connection of the common compensation connection 56 of each light-emitter circuit 10 is connected together in a single electrical connection.

The embodiment of FIGS. 18 and 19 have an additional voltage drop across the transfer transistor 54 but has the advantage of requiring fewer transistors for self-compensating circuits 5 that have three or more light-emitter circuits 10. The embodiment also has the advantage of requiring only a single electrical connection between light-emitter circuits 10 regardless of the number of light-emitter circuits 10. In contrast, the light-emitter circuits 10 in the embodiment of FIGS. 1 and 4 each require an electrical connection from all of the other light-emitter circuits 10 in the self-compensating circuit 5. For example, in the case of FIG. 4 with four light-emitter circuits 10, each light-emitter circuit 10 has three electrical connections from other light-emitter circuits 10. Thus, the embodiment of FIGS. 18 and 19 can have fewer components and wires, simplifying and reducing the size of the self-compensating circuit 5, thereby improving yields and reducing costs.

Figure 20:
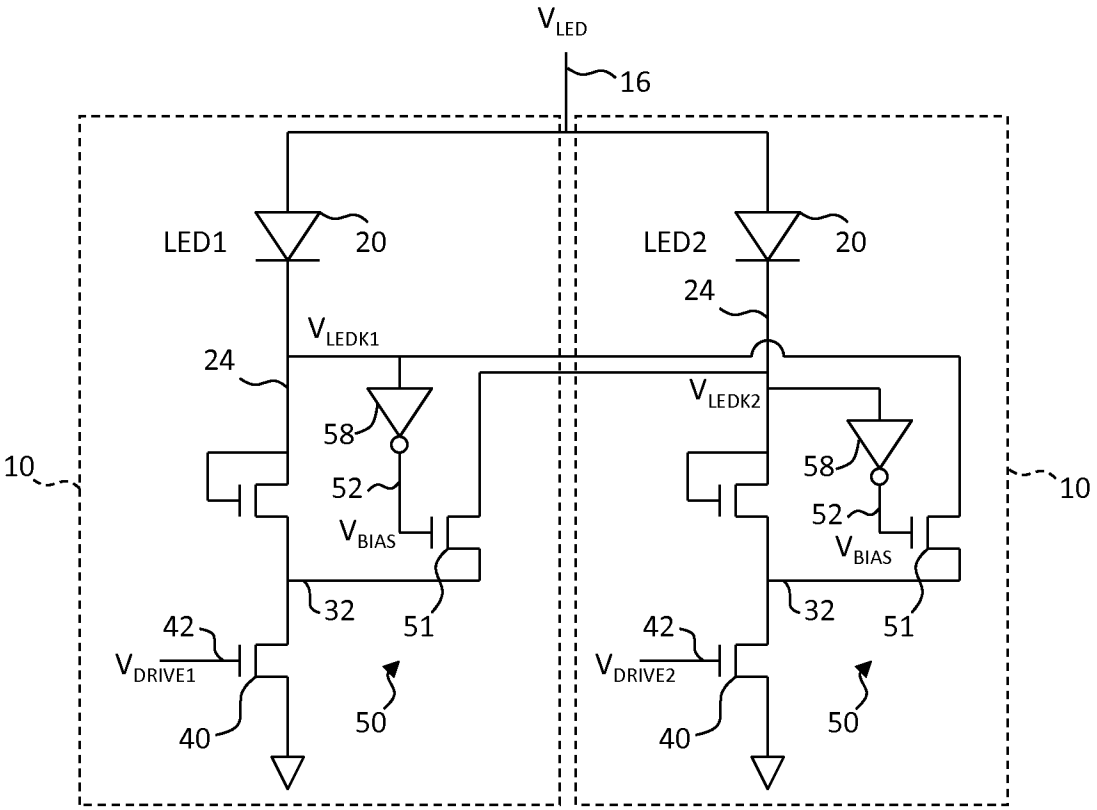
FIGS. 20-22 are schematic illustrations of an embodiment of the present invention including an inverter.
Figure 21:
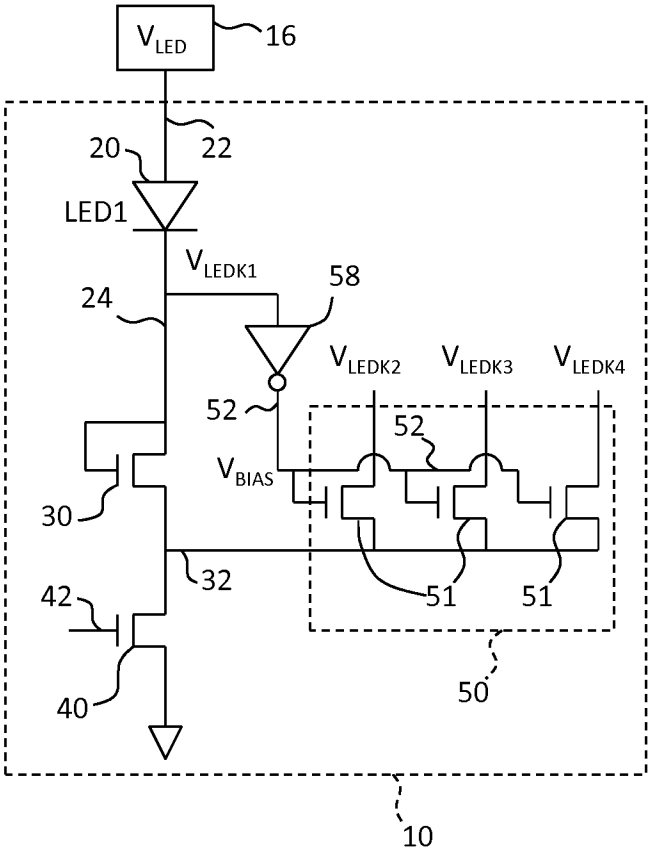
Figure 22:
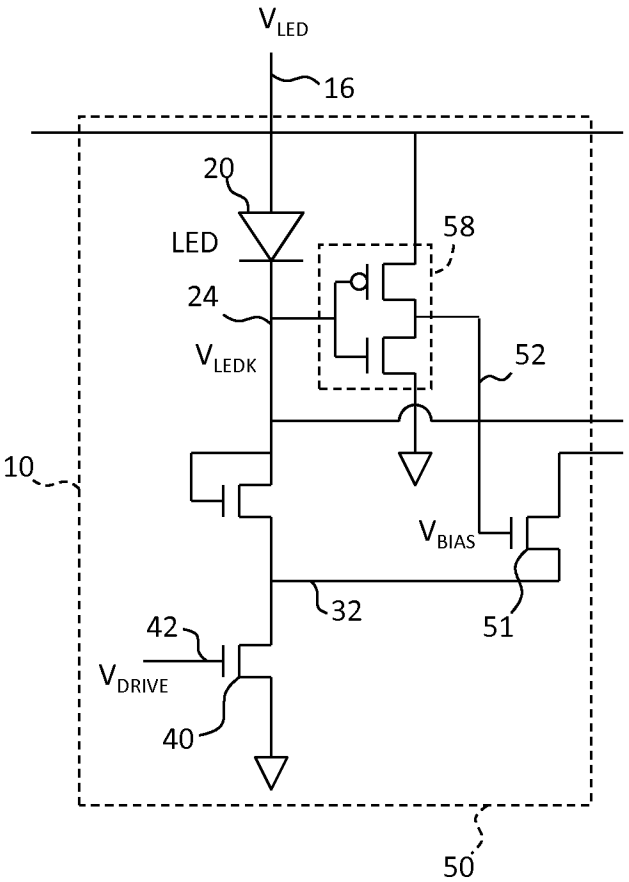

Referring next to the embodiments illustrated in FIGS. 20 and 21, an inverter 58 electrically connects the emitter connection 24 of each light-emitter circuit 10 to the bias connection 52 of the corresponding compensation transistors 51 in the corresponding compensation circuit 50. The schematic illustration of FIG. 20 corresponds to the circuit illustrated in FIG. 1. The schematic illustration of FIG. 21 corresponds to the circuit illustrated in FIG. 4. The use of an inverter 58 removes an external connection to a bias signal and provides a more self-contained light-emitter circuit 10 that, in some circumstances, has a more consistent performance in the presence of manufacturing variability. Referring to FIG. 22, in a useful embodiment the inverter 58 includes a CMOS transistor configured as an inverter, for example including a p-channel transistor connected in series with an n-channel transistor with a common gate and the series connection providing the bias connection 52. In such a structure, when the light emitter 20 is operating properly the emitter is pulled high and the n-channel transistor turns on to connect the bias connection 52 to the ground and turn off the compensation transistor 51. When the light emitter 20 is missing or defective, the emitter is pulled low and the p-channel transistor turns on to connect the bias connection 52 to the $V_{LED}$ power supply voltage and turn on the compensation transistors 51. This arrangement is effective in any of the embodiments shown, for example in FIGS. 1, 4, 18, and 19, although it is not specifically illustrated with the transfer transistors 54.

In embodiments of the present invention, the diode-connected transistors, the control transistors 30 and the transfer transistors 54, can be replaced with diodes, for example PN junctions or Schottky diodes; such embodiments are included in the present invention. In such an embodiment, the gate and drain of the diode-connected transistors provide a single diode connection and the source provides another diode connection. Thus, a transistor with a gate and drain connected in common is equivalent to a diode and a diode used in place of a diode-connected transistor with a gate and drain connected in common is included in the present invention.

The relative amount of the current $I_H$ passing through each of the compensation transistor 51 is in proportion to the compensation transistor 51 size since all of the compensation transistors 51 in the light-emitter circuit 10 have a common drain connection to the compensation connection 32 that conducts current through the common drive transistor 40. Thus, in an embodiment, the size of the compensation transistors 51 is selected in correspondence with the size of the control transistors 30. Since unnecessarily large transistors are a waste of material and substrate space, it is useful to reduce the size of transistors where possible. In a useful example, the compensation transistors 51 in the light-emitter circuit 10 each have a size equal to or less than the control transistor 30. Moreover, the size of the compensation transistors 51 in the light-emitter circuit 10 can be inversely related to the number of compensation transistors 51 so that as the number of the compensation transistors 51 increases, the size of the compensation transistors 51 decreases. In a particular embodiment, the size of the compensation transistors 51 in the light-emitter circuit 10 is approximately equal to the size of the control transistors 30 divided by the number of the compensation transistors 51, for example within 20%, within 10%, or within 5%.

For example, the embodiment illustrated in FIG. 4 illustrates four light-emitter circuits 10 each having three compensation transistors 51. In an embodiment, each of the compensation transistors 51 is one third of the size of the control transistors 30. Thus, when an identical drive signal 42 is applied to each of the drive transistors 40 of the four light-emitter circuits 10, if LED1, LED2, LED3, and LED4 are all functioning properly they will each emit the same amount of light (assuming they are the same type and size of LED). If one of the LEDs if faulty, the other three LEDs will each emit an increased amount of light, as discussed above. Since the total amount of current $I_H$ passing through the compensation transistors 51 is desirably the same amount of current $I_{DRIVE}$ that would pass through the LED if it was not faulty, the total size of the compensation transistors 51 together is usefully the same as the control transistor 30 and therefore the size of each of the three individual compensation transistors 51 is one third the size of the control transistors 30.

Figure 8:
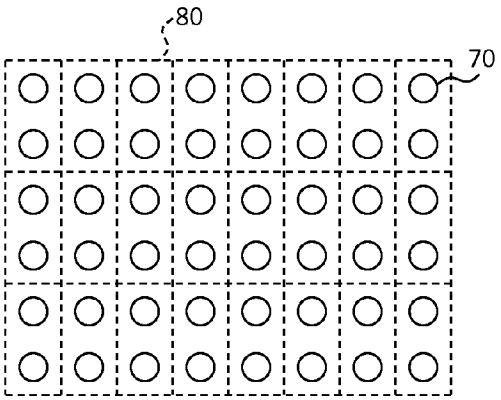
FIGS. 7-9 are schematic illustrations of pixel groups in accordance with an embodiment of the present invention.
Figure 7:
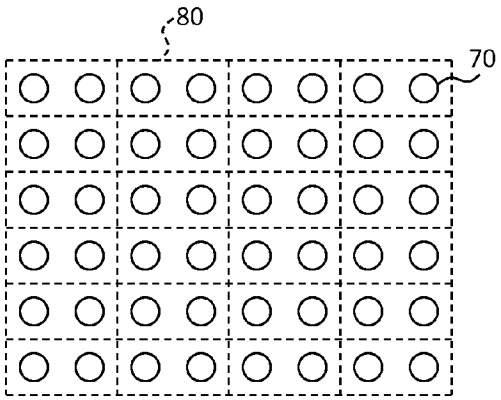
Figure 9:
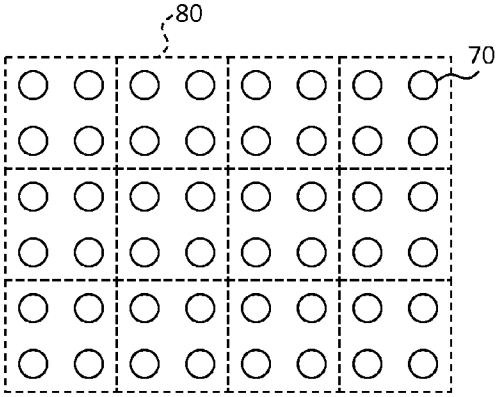

As shown in FIG. 6, the self-compensating display 4 of the present invention can include an array of pixels 70 forming rows and columns of pixels 70 on a display substrate 6. Each pixel 70 is controlled by the self-compensating circuit 5 (FIG. 1). As shown in FIG. 7, the pixels 70 are arranged in groups 80. In one embodiment and as shown in FIGS. 7-9, the pixels 70 are arranged in exclusive groups 80 of spatially adjacent pixels 70. Spatially adjacent pixels 70 are pixels 70 that have no other pixel 70 between the spatially adjacent pixels 70. In an exclusive group 80 of pixels 70, each pixel 70 in the group 80 is included in only one group 80 so that no pixel 70 is in more than one group 80. The pixels 70 (corresponding to a light emitter 20) in each group 80 can be part of a common self-compensating circuit 5 and each pixel 70 is included in a different light-emitter circuit 10. In such an embodiment, each compensation transistor 51 in the light-emitter circuit 10 is connected to a different one of the emitter connections 24 in the light-emitter circuits 10 of each pixel 70 in the exclusive group 80. Thus, the number of compensation transistors 51 in each light-emitter circuit 10 is equal to one less than the number of pixels 70 in the exclusive group 80 (as shown in FIGS. 1 and 4).

Furthermore, in a useful embodiment and as illustrated in FIGS. 7-9, the pixels 70 in an exclusive group 80 are spatially adjacent in the array. As shown in FIGS. 7 and 8, each exclusive group 80 includes only two pixels 70. The two pixels 70 in each exclusive group 80 in FIG. 7 are spatially adjacent in different columns. The two pixels 70 in each exclusive group 80 in FIG. 8 are spatially adjacent in different rows. In both of the examples of FIGS. 7 and 8, if either of the pixels 70 in any exclusive group 80 fails, the other of the pixels 70 in the exclusive group 80 will emit additional light in compensation.

Referring to FIG. 9, each exclusive group 80 includes only four spatially adjacent pixels 70. The four pixels 70 are arranged in a two-by-two array forming two rows and two columns. In this embodiment, if any of the four pixels 70 in an exclusive group 80 fails, the other of the pixels 70 in the exclusive group 80 will emit additional light in compensation. The arrangement of FIG. 9 can correspond to the self-compensating circuit 5 of FIG. 4.

In the embodiment of FIG. 7, for example, if a pixel 70 spatially on the left side of the pixel pair making up an exclusive group 80 fails, the pixel 70 spatially on the right side of the pixel pair will compensate. Similarly, if the pixel 70 spatially on the right side of the pixel pair making up an exclusive group 80 fails, the pixel 70 spatially on the left side of the pixel pair will compensate. In an alternative embodiment, if a pixel 70 fails, a pixel 70 with a location specified with respect to the failed pixel 70 will compensate, for example the pixel 70 always to the left (ignoring the edges of the pixel array). Such an embodiment employs non-exclusive, overlapping groups 80 of spatially adjacent pixels 70.

Figure 10A:
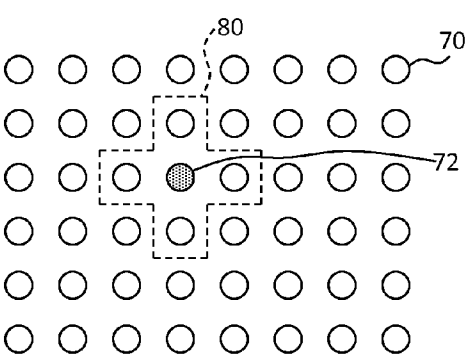
FIGS. 10A-10D are illustrations of overlapping pixel groups arranged in accordance with embodiments of the present invention.
Figure 10B:
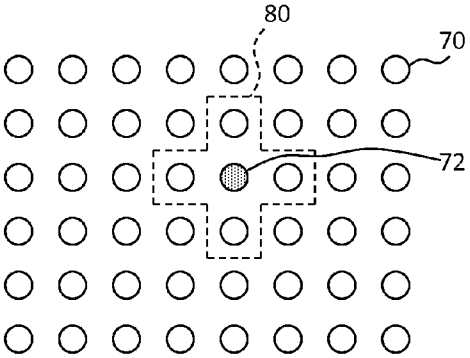
Figure 10C:
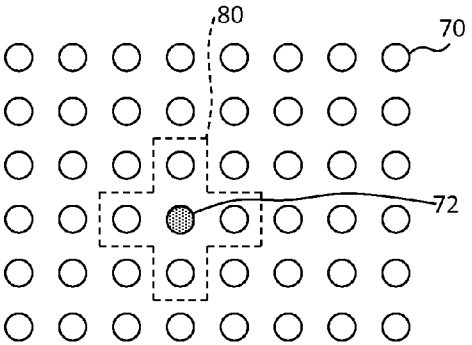
Figure 10D:
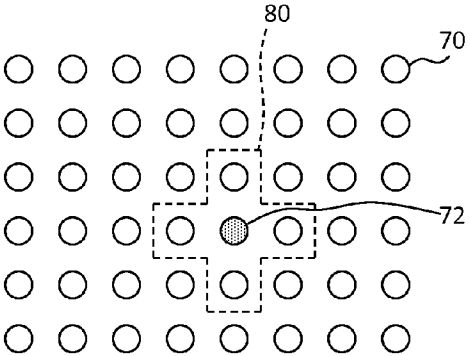

FIGS. 10A-10D illustrate a common array of pixels 70 arranged in non-exclusive groups 80 of five spatially adjacent pixels 70 forming a "+" symbol including a central pixel 72, a left pixel 70 to the left of the central pixel 72, a right pixel 70 to the right of the central pixel 72, an upper pixel 70 above the central pixel 72, and a lower pixel 70 below central pixel 72. The group 80 of pixels 70 is shown with the central pixel 72 located at (x, y) coordinate (4, 3) in FIG. 10A. If the central pixel 72 fails, the left, right, upper, and lower pixels 70 in the group 80 will emit additional light to compensate for the failure of the central pixel 72. This is accomplished by connecting the emitter connections 24 of the left, right, upper, and lower pixels 70 to the sources of the compensation transistors 51 of FIG. 10A. However, if the right pixel 70 failed, because group 80 of FIG. 10A is not an exclusive group 80, the central, left, upper, and lower pixels 70 would not compensate. Instead, referring to FIG. 10B, the right pixel 70 of FIG. 10A (at location 5, 3) is the central pixel 72 as shown in FIG. 10B and the pixels 70 of the group 80 indicated in FIG. 10B would compensate. The groups 80 of FIGS. 10A and 10B overlap because the central pixel 72 and right pixel 70 of FIG. 10A are also found in the group 80 of FIG. 10B as the left pixel 70 and the central pixel 72. Similarly, if the bottom pixel 70 of FIG. 10A failed, the group 80 of pixels 70 found in FIG. 10C would provide compensation. In the example of FIG. 10D, the upper and left pixels 70 of the group 80 correspond to the right and lower pixels 70 of FIG. 10A. Forming the overlapping groups 80 of FIGS. 10A-10D is simply a matter of connecting the emitter connections 24 of the non-central pixels 70 in each group 80 to the compensation transistors 51 of the central pixel 72. Such a non-exclusive group structure provides a more consistent compensation scheme across the array of pixels 70.

Figure 11:
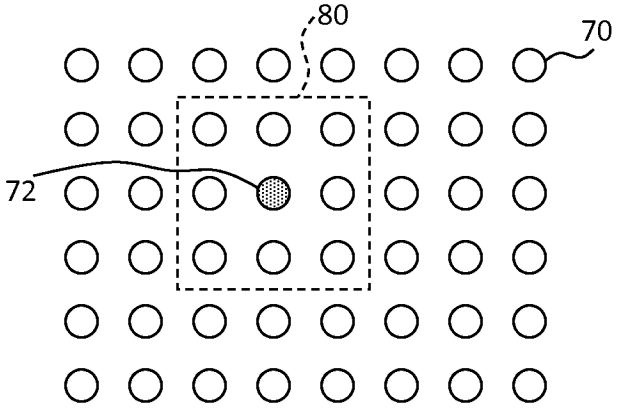
FIG. 11 is an illustration of a pixel group arranged in accordance with embodiments of the present invention.

Referring to FIG. 11, a group 80 of adjacent pixels 70 is arranged in a three-by-three matrix of three rows and three columns with the central pixel 72 having a pixel 70 above, a pixel 70 below, a pixel 70 on the left side, a pixel 70 on the right side, a pixel 70 on the upper left, a pixel 70 on the upper right, a pixel 70 on the lower left, and a pixel 70 on the lower right. Such a group 80 can be exclusive or non-exclusive, depending on the electrical connection of the emitter connection 24 and the compensation transistors 51.

The pixels on the upper right, the upper left, the lower right and the lower left (the corner pixels) are farther from the central pixel than are the pixels to the left and right (the row pixels) and above and below (the column pixels). According to a further embodiment of the present invention, the amount of compensatory light from the closer row and column pixels is greater than the amount of light from the farther corner pixels, that is the pixels above and below and to the left and right of the central pixel are brighter than the corner pixels, when compensating for a defective or missing central pixel. Such a difference in brightness more accurately compensates for the missing light as perceived by the human visual system.

One mechanism for providing differing amounts of light from the different pixels is to use compensation transistors having different sizes and are therefore capable of conducting different amounts of current. Thus, according to an embodiment and referring to FIG. 23, in a compensation circuit 50 the one or more compensation transistors 51 includes at least a first compensation transistor 51A and a second compensation transistor 51B different from the first compensation transistor 51A and the first and second compensation transistors 51A and 51B have different sizes. The different compensation transistor sizes are illustrated schematically by the differently sized boxes representing the first and second compensation transistors 51A, 51B in the illustration. A further embodiment of the present invention enables differently sized compensation transistors 51A, 51B by constructing transistors having a common length but a different width. Such an arrangement of transistor elements promotes an efficient transistor layout in a semiconductor wafer or substrate. Thus, in an embodiment, the length of a first compensation transistor 51A is the same as the length of a second compensation transistor 51B and the width of the first compensation transistor 51A is different from the width of the second compensation transistor 51B so that their corresponding light emitters emit different amounts of light. For example the width of the first compensation transistor 51A is greater than the width of the second compensation transistor 51B to enable the first compensation transistor 51A to conduct more current than the second compensation transistor 51B and the light emitter corresponding to the first compensation transistor 51A to emit more light than the light emitter corresponding to second compensation transistor 51B.

Figure 23:
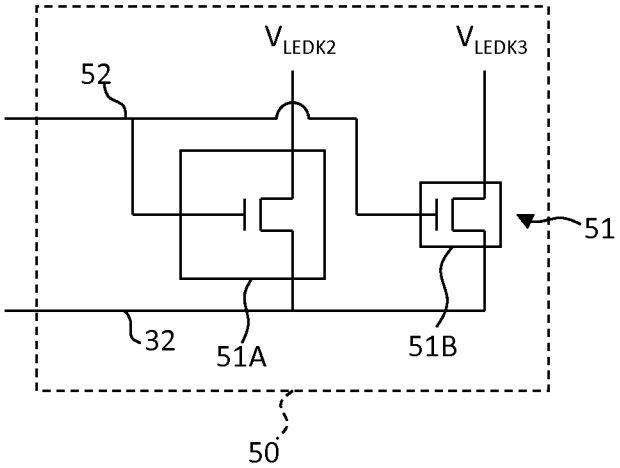
FIG. 23 is a schematic illustration of an embodiment of the present invention having compensation transistors of different sizes.

The relative amount of light emitted from the different light-emitter circuits 10 can be related to the relative distances between the light emitters that are compensating for the defective or missing light emitter. Thus, in a three-by-three pixel embodiment a central light emitter 20 in a light-emitter circuit 10 of the plurality of light-emitter circuits 10 has neighboring light emitters 20 from different light-emitter circuits 10 that are above, below, and to either side of the central light emitter 20 that are a first distance from the central light emitter 10. Likewise, the central light emitter 20 has neighboring light emitters 20 from different light-emitter circuits 10 that are to the upper right, upper left, lower right, and lower left of the central light emitter 20 that are a second distance from the central light emitter 10 that is greater than the first distance. In an embodiment, the ratio of the first distance to the second distance is inversely proportional to the ratio of the size of the first compensation transistor 51A to the size of the second compensation transistor 51B (e.g., as shown in FIG. 23 for the two compensation transistors 51A, 51B). Thus, compensation transistors corresponding to light emitters that are closer are larger than compensation transistors corresponding to light emitters that are farther away.

Referring back to FIG. 11, the pixel array is a regular array of pixels arranged in columns and rows separated by the same distance. If the distance between neighboring rows or columns is arbitrarily considered to be one, then the distance between the central pixel and a corner pixel is the square root of two, or approximately 1.414. In such an arrangement, therefore, it is useful to form the compensation transistors 51 corresponding to the light-emitter circuits 10 of the neighboring row or column pixels with a size that is approximately 1.414 times the size of the light-emitter circuits 10 of the corner pixels. If the rows and columns are separated by different distances, the Pythagorean theorem can be readily used to calculate the relative distances of the corner, column, and row pixels from the central pixels. For example, if the rows are twice as far apart as the columns, the relative sizes of the neighbors in a row to the sizes of the pixel neighbors in a column to the sizes of the pixels in the corner will be 1:2:2.24. 2.24 is approximately the square root of 5, which is equal to one squared plus two squared.

Thus, in an embodiment, the plurality of light-emitter circuits 10 includes first through ninth light-emitter circuits 10 having first through ninth light emitters 20, respectively. The first light-emitter circuit 10 includes compensation transistors 51 having drains connected to the emitter connections 24 of the other eight light-emitter circuits 10.

The first through ninth light emitters 20 are arranged in a three-by-three array with the first light emitter 20 in the center, the second and third light emitters 20 in a common row with the first light emitter 20 and on the left and right sides of the first light emitter 20, the fourth and fifth light emitters 20 in a common column with the first light emitter 20 and above and below the first light emitter 20, and the sixth, seventh, eighth, and ninth light emitters 20 each in a row and in a column adjacent to the first light emitter 20. The second through fifth light emitters 20 have a first common size and the sixth through ninth light emitters 20 have a second common size different from the first common size. In an embodiment, the ratio of the first common size to the second common size is approximately 1.414 to 1.

In an embodiment of the present invention, the self-compensating control circuits 5 are formed in a thin-film of silicon formed on the display substrate 6. Such structures and methods for manufacturing them are well known in the thin-film display industry. In an alternative embodiment illustrated in FIG. 12, the light emitters 20 are formed in a separate substrate, for example a crystalline silicon substrate, and applied to a display substrate surface 7 of the display substrate 6, for example by micro-transfer printing. For a discussion of micro-transfer printing techniques see U.S. Pat. Nos. 8,722,458, 7,622,367 and 8,506,867, each of which is hereby incorporated by reference.

Similarly, the supporting electronic circuit components of the light-emitter circuits 10 excluding the light emitters 20 can be constructed in or on a substrate separate from the display substrate 6 or the light emitters 20 as a light-emitter control circuit 11 and transferred to the display substrate 6. Each group 80 of light emitters 20 controlled by a common light-emitter control circuit 11 forms a pixel element 74 and spatially adjacent pixel elements 74 can form groups 80. Alternatively, the group 80 of light emitters 20 controlled by a common light-emitter control circuit 11 and forming the pixel element 74 can also define a group 80 (not shown). Wire interconnections are omitted from FIG. 12 for illustration clarity. As noted above, the pixels 70 of a group 80 can correspond to the light emitters 20 of the self-compensating circuit 5 of the present invention so that the pixels 70 of the group 80 mutually compensate for any defective pixels 70. The pixel elements 74 can include light emitters 20 emitting light of different colors or of the same color.

Figure 12:
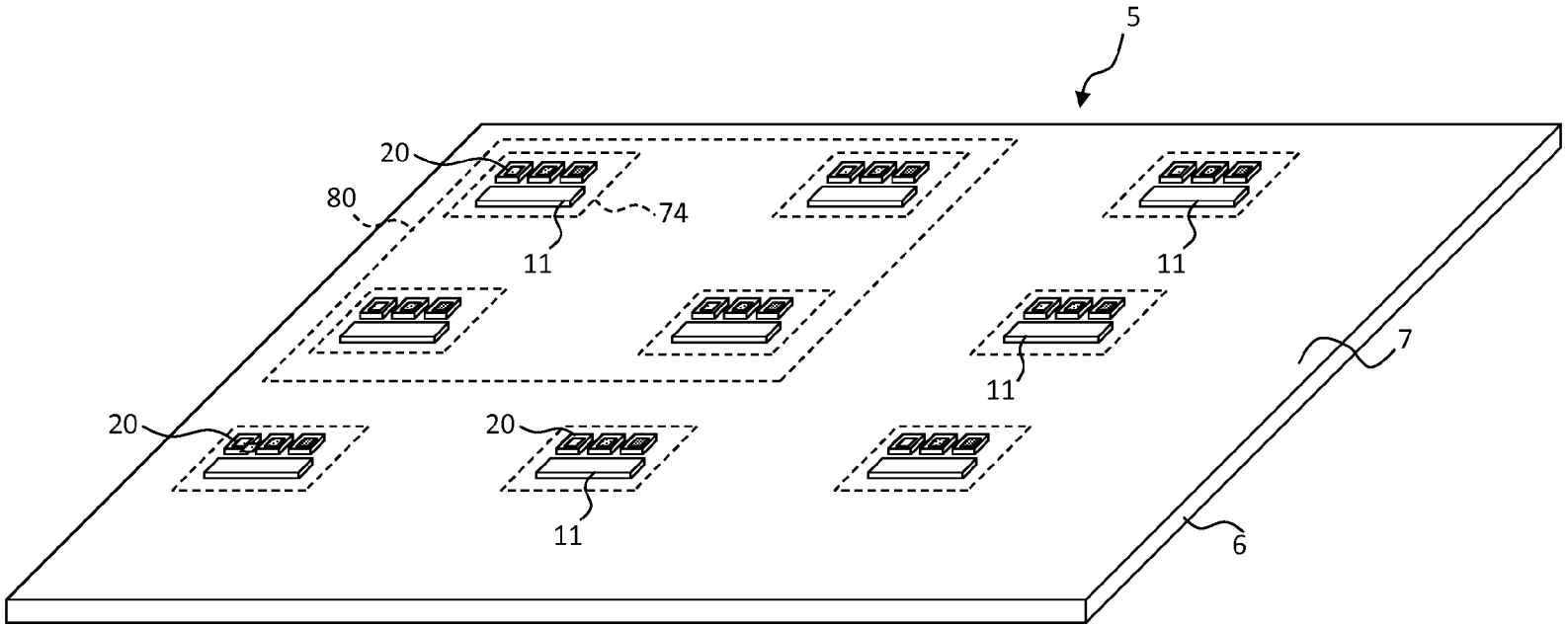
FIG. 12 is a perspective of an embodiment of the present invention.
Figure 13:
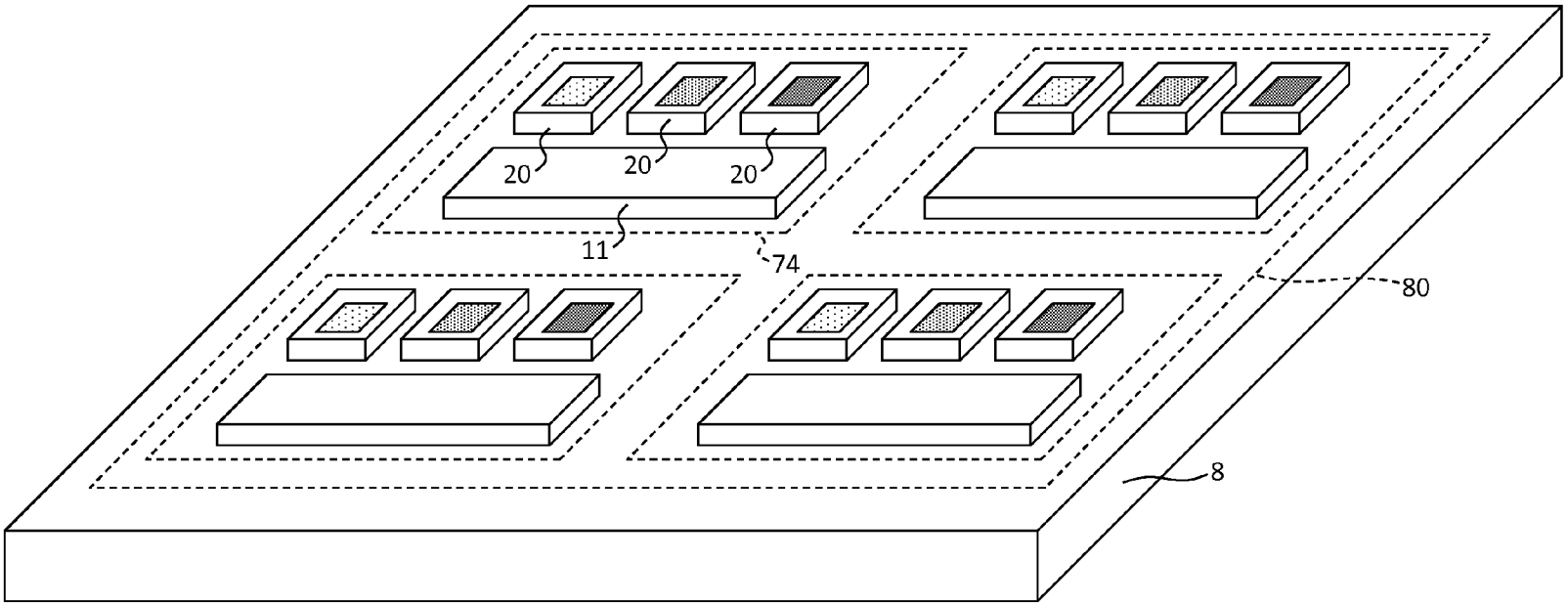
FIG. 13 is a perspective of a pixel element in accordance with an embodiment of the present invention.
Figure 14:
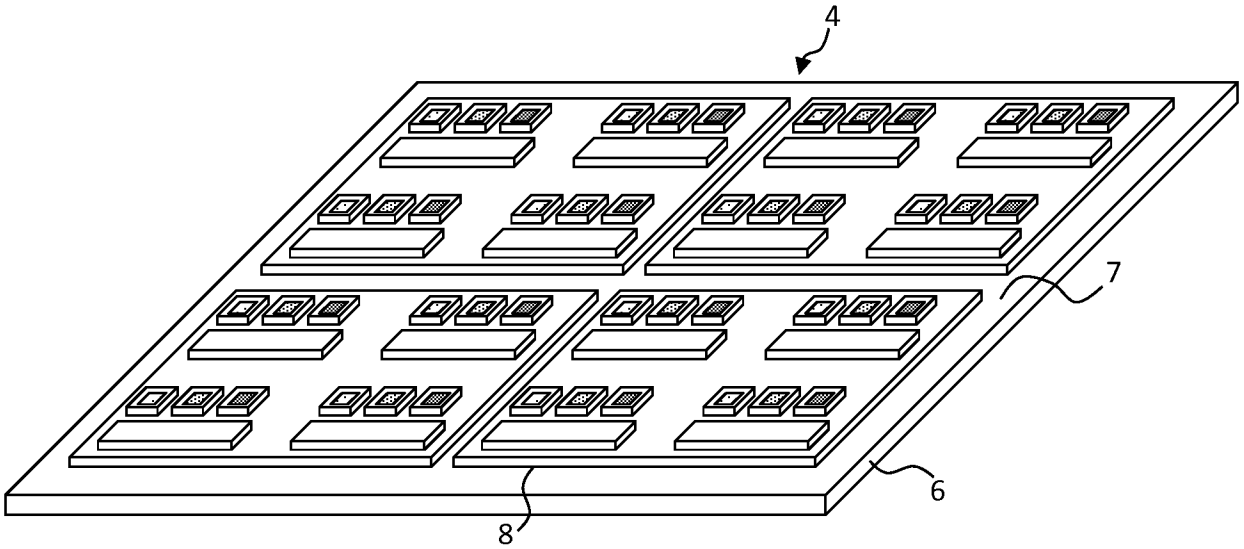
FIG. 14 is a perspective of an embodiment of the present invention.

Referring to FIG. 13, in another embodiment of the present invention, pixels 70 in a group 80, for example an exclusive group 80, including the light emitters 20 and the light-emitter control circuit 11 forming the pixel elements 74 are located on a pixel substrate 8 that is independent and separate from the display substrate 6 (FIG. 12) and then optionally interconnected using photolithographic methods and tested. The pixel substrates 8 are mounted on the display substrate surface 7 of the display substrate 6, as shown in FIG. 14. The light-emitter circuits 10 (FIG. 1) on the pixel substrates 8 are then interconnected, for example using photolithographic methods known in the art. A further discussion of utilizing pixel substrates in a display can be found in commonly assigned co-pending U.S. Patent Application Ser. No. 62/055,472 filed Sep. 25, 2014, entitled Compound Micro-Assembly Strategies and Devices, the contents of which are incorporated by reference herein in its entirety.

The self-compensating circuit 5 of the present invention can be constructed using circuit design tools and integrated circuit manufacturing methods known in the art. LEDs and micro-LEDs are also known, as are circuit layout and construction methods. The self-compensating displays 4 of the present invention can be constructed using display and thin-film manufacturing method independently of or in combination with micro-transfer printing methods, for example as are taught in commonly assigned co-pending U.S. patent application Ser. No. 14/743,981 entitled Micro-Assembled Micro LED Displays and Lighting Elements and filed Jun. 18, 2015, the contents of which are hereby incorporated by reference.

Figure 15:
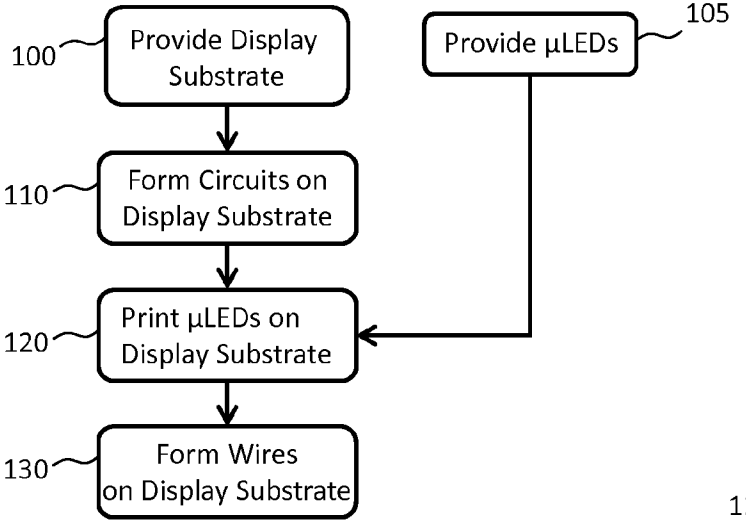

Referring also to FIG. 15 and also to FIG. 12, in a method of the present invention the display substrate 6 is provided in step 100. The display substrate 6 can be any conventional substrate such as glass, plastic, or metal or include such materials. The display substrate 6 can be transparent, for example having a transmissivity greater than or equal to 50%, 80%, 90%, or 95% for visible light. The display substrate 6 usefully has two opposing smooth sides (such as the display substrate surface 7) suitable for material deposition, photolithographic processing, or micro-transfer printing of micro-LEDs. The display substrate 6 can have a size of a conventional display, for example a rectangle with a diagonal length of a few centimeters to one or more meters and a thickness of 0.1 mm, 0.5 mm, 1 mm, 5 mm, 10 mm, or 20 mm. Such substrates are commercially available. Before, after, or at the same time the display substrate 6 is provided in step 100, the light emitters 20 (e.g. micro-LEDs) are provided in step 105, using conventional photolithographic integrated-circuit processes on semiconductor substrates. The micro-LED semiconductor substrates are much smaller than and separate and distinct from the display substrate 6 and can include different materials. In an alternative method, the light-emitter circuit 10 is made in a semiconductor coating formed on the display substrate 6 using conventional substrate processing methods, for example employing low- or high-temperature polysilicon processed, for example with excimer lasers, to form localized crystalline silicon crystals (e.g. LTPS) as is known in the display art. Methods, tools, and materials for making LEDs are well known in the lighting and LCD backlight industries.

In step 110 conductive wires, for example electrical interconnections, are formed on the display substrate 6 using conventional photolithographic and display substrate processing techniques known in the art, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections Inkjet and screen-printing deposition processes and materials can be used to form the patterned conductive wires or other electrical elements.

In an embodiment, the light emitters 20 (e.g. micro-LEDs) formed in step 105 are transfer printed to the display substrate 6 in step 120 in one or more transfers. The light-emitter control circuits 11 can also be formed in a separate substrate such as a crystalline semiconductor substrate and transferred to the display substrate 6. Micro-transfer printing methods are known in the art and are referenced above. The transferred light emitters 20 are then interconnected in step 130 using similar materials and methods as in step 110, for example with the conductive wires and optionally including connection pads and other electrical connection structures known in the art, to enable a display controller to electrically interact with the light emitters 20 to emit light in the self-compensating display 4. In alternative processes, the transfer or construction of the light emitters 20 is done before or after all of the conductive wires are in place. Thus, in embodiments the construction of the conductive wires can be done before the light emitters 20 light-emitter control circuits 11 are printed (in step 110 and omitting step 130) or after the light emitters 20 are printed (in step 130 and omitting step 110), or using both steps 110 and 130. In any of these cases, the light emitters 20 and the light-emitter control circuits 11 are electrically connected with the conductive wires, for example through connection pads on the top or bottom of the light emitters 20.

Figure 16:
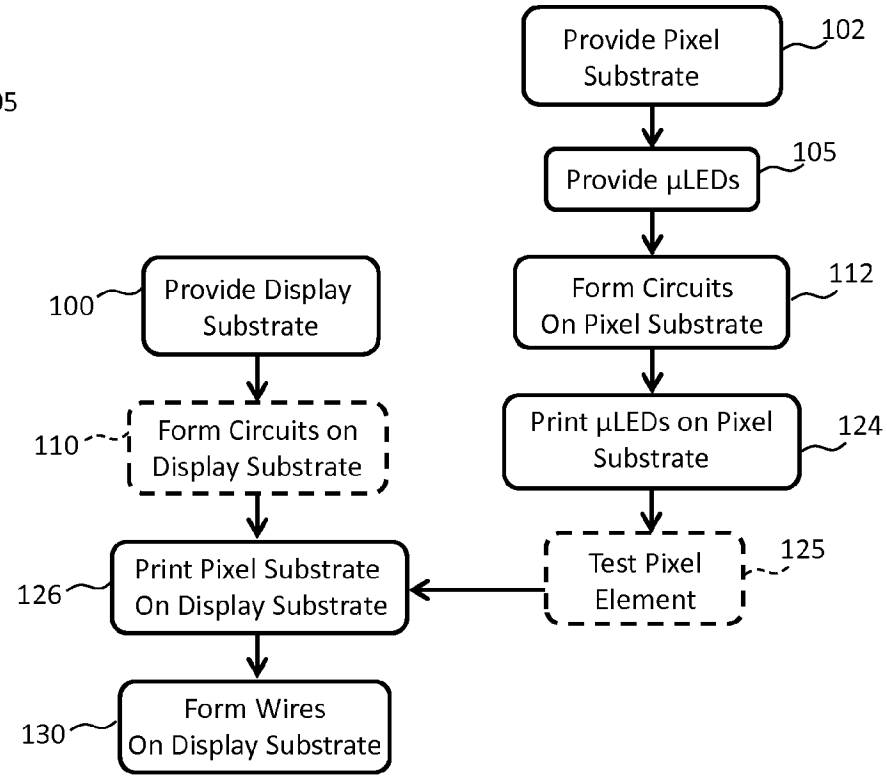
FIGS. 15-16 are flow charts illustrating methods of the present invention.

Referring next to FIG. 16, in yet another process and referring also to FIGS. 13 and 14, the pixel substrate 8 is provided in step 102 in addition to providing the display substrate 6 (in step 100), providing the light emitters 20 (in step 105), and providing the light-emitter control circuit 11. The pixel substrate 8 can, for example, be similar to the display substrate 6 (e.g. made of glass or plastic) but in a much smaller size, for example having an area of 50 square microns, 100 square microns, 500 square microns, or 1 square mm and can be only a few microns thick, for example 5 microns, 10 microns, 20 microns, or 50 microns. Any desired circuits or wiring patterns are formed on the pixel substrate 8 in step 112. Alternatively, circuitry and wiring are formed on the pixel substrate 8 after the light emitters 20 and the light-emitter control circuit 11 are provided on the pixel substrate 8 in the following step. The light emitters 20 (e.g. micro-LEDs) and the light-emitter control circuit 11 are transfer printed onto the pixel substrate 8 in step 124 using one or more transfers from one or more semiconductor wafers to form the pixel element 74 with the pixel substrate 8 separate from the display substrate 6, the substrate of the light-emitter control circuit 11, and the substrates of the light emitters 20. In an alternative embodiment, not shown, the pixel substrate 8 includes a semiconductor and the light emitters 20 and the light-emitter control circuit 11 and, optionally, some electrical interconnections, are formed in the pixel substrate 8. In optional step 142, electrical interconnects are formed on the pixel substrate 8 to electrically interconnect the light emitters 20 and the light-emitter control circuit 11, for example using the same processes that are employed in steps 110 or 130. In optional step 125, the pixel elements 74 on the pixel substrates 8 are tested and accepted, repaired, or discarded. In step 126, the pixel elements 74 are transfer printed or otherwise assembled onto the display substrate 6 and then electrically interconnected in step 130 with the conductive wires and to connection pads for connection to a display controller. The steps 102 and 105 can be done in any order and before or after any of the steps 100 or 110.

By employing the multi-step transfer or assembly process of FIG. 15, increased yields are achieved and thus reduced costs for the self-compensating display 4 of the present invention.

As is understood by those skilled in the art, the terms "over" and "under" are relative terms and can be interchanged in reference to different orientations of the layers, elements, and substrates included in the present invention. For example, a first layer on a second layer, in some implementations means a first layer directly on and in contact with a second layer. In other implementations a first layer on a second layer includes a first layer and a second layer with another layer there between.

Having described certain implementations of embodiments, it will now become apparent to one of skill in the art that other implementations incorporating the concepts of the disclosure may be used. Therefore, the invention should not be limited to the described embodiment, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

4 self-compensating display
5 self-compensating circuit
6 display substrate
7 display substrate surface
8 pixel substrate
10 light-emitter circuit

11 light-emitter control circuit
16 power supply
20 light emitter
22 power connection
24 emitter connection
30 control transistor
32 compensation connection
40 drive transistor
42 drive signal
50 compensation circuit
51 compensation transistor
51A large compensation transistor
51B small compensation transistor
52 bias connection
54 transfer transistor
56 common compensation connection
58 inverter
60 ground
70 pixel
72 central pixel
74 pixel element
80 group of pixels
90 transistor
91 drain
92 source
93 gate
100 provide display substrate step
102 provide pixel substrate step
105 provide light emitters step
110 form circuits on display substrate step
112 form circuits on pixel substrate step
120 print micro-LEDs on display substrate step
124 print micro-LEDs on pixel substrate step
125 optional test pixel element step
126 print pixel substrate on display substrate step
130 form wires on display substrate step

The invention claimed is:

1. A self-compensating circuit for controlling pixels in a display, comprising:

a plurality of light-emitter circuits, each light-emitter circuit comprising:

a light emitter having a power connection to a power supply and an emitter connection;

a control transistor having a gate and a drain connected to the emitter connection and a source connected to a compensation connection;

a drive transistor having a gate connected to a drive signal, a drain connected to the compensation connection, and a source connected to a ground; and a compensation circuit comprising one or more compensation transistors, each compensation transistor having a gate connected to a bias connection, a source connected to the compensation connection, and a drain, wherein the drain of each compensation transistor in each light-emitter circuit is connected to an other emitter connection of one or more light-emitter circuits other than the light-emitting circuit of which the compensation transistor is a part, thereby emitting compensatory light from the one or more light-emitter circuits when the light emitter is faulty.

2. The self-compensating circuit of claim 1, wherein the light emitters are inorganic light-emitters.

3. The self-compensating circuit of claim 2, wherein the inorganic light emitters are inorganic light-emitting diodes.

4. The self-compensating circuit of claim 1, wherein the compensation transistors in a light-emitter circuit have a size equal to or smaller than the control transistor.

5. The self-compensating circuit of claim 1, wherein the size of the compensation transistors in a light-emitter circuit is inversely related to the number of compensation transistors in the light-emitter circuit.

6. The self-compensating circuit of claim 1, wherein the size of the compensation transistors in a light-emitter circuit is less than or equal to the size of the control transistor divided by the number of compensation transistors.

7. The self-compensating circuit of claim 1, wherein the number of compensation transistors in each light-emitter circuit is one fewer than the number of light emitters in the self-compensating circuit.

8. The self-compensating circuit of claim 1, wherein each compensation circuit of the plurality of light-emitter circuits has one compensation transistor and the drain of the one compensation transistor of each of the plurality of light-emitter circuits is electrically connected in common to a common compensation connection and wherein each compensation circuit comprises a transfer transistor having a gate and a drain connected to the emitter connection and a source connected to the common compensation connection.

9. A self-compensating display, comprising an array of light emitters forming rows and columns on a display substrate, each light emitter controlled by the self-compensating circuit of claim 1.

10. The self-compensating display of claim 9, wherein the light emitters are arranged in exclusive groups of adjacent light emitters so that each light emitter is a member of only one group and wherein the drain of each compensation transistor in a light-emitter circuit is connected to a different one of the other emitter connections in the light-emitter circuits of the other light emitters in the exclusive group.

11. The self-compensating display of claim 9, wherein the number of compensation transistors in each light-emitter circuit is equal to one less than the number of light emitters in the exclusive group.

12. The self-compensating display of claim 9, wherein each group of adjacent light emitters comprises two light emitters located in adjacent rows.

13. The self-compensating display of claim 9, wherein each group of adjacent light emitters comprises two light emitters located in adjacent columns.

14. The self-compensating display of claim 9, wherein each group of adjacent light emitters comprises four light emitters located in a two by two array forming two rows and two columns.

15. The self-compensating display of claim 9, wherein each group of adjacent light emitters is located on a pixel substrate that is independent and separate from the display substrate and the pixel substrates are mounted on the display substrate.

16. The self-compensating display of claim 9, wherein each light emitter is located on a pixel substrate that is independent and separate from the display substrate and the pixel substrates are mounted on the display substrate.

17. The self-compensating display of claim 9, wherein the light emitters are arranged in groups of adjacent light emitters and wherein the source of each compensation transistor in each light-emitter circuit is connected to a different one of the emitter connections in the light-emitter circuits of each light emitter in the group.

18. The self-compensating display of claim 17, wherein at least one group of light emitters overlaps another group of light emitters so that at least one light emitter is a member of more than one group.

19. A self-compensating circuit for controlling pixels in a display, comprising:

a plurality of light-emitter circuits, each light-emitter circuit comprising:

a light emitter having a power connection to a power supply and an emitter connection;

a control transistor having a gate and a drain connected to the emitter connection and a source connected to a compensation connection;

a drive transistor having a gate connected to a drive signal, a drain connected to the compensation connection, and a source connected to a ground;

one or more compensation transistors, each compensation transistor having a gate connected to a bias connection, a source connected to the compensation connection, and a drain, wherein the number of compensation transistors in each light-emitter circuit is one fewer than the number of light emitters in the self-compensating circuit and the drain of each compensation transistor in each light-emitter circuit is connected to the emitter connection of each of one or more light-emitter circuits other than the light-emitter circuit of which the compensation transistor is a part, thereby emitting compensatory light from the one or more light-emitter circuits when the light emitter is faulty.

20. A self-compensating circuit for controlling pixels in a display, comprising:

a plurality of light-emitter circuits, each light-emitter circuit comprising:

a light emitter having a power connection to a power supply and an emitter connection;

a control transistor having a gate and a drain connected to the emitter connection and a source connected to a compensation connection;

a drive transistor having a gate connected to a drive signal, a drain connected to the compensation connection, and a source connected to a ground;

a compensation transistor having a gate connected to a bias connection, a source connected to the compensation connection, and a drain connected to a common compensation connection; and a transfer transistor having a gate and a drain connected to the emitter connection and a source connected to the common compensation connection, wherein the common compensation connection of each of the plurality of light-emitter circuits is electrically connected in common.

* * * * *